US008887431B2

(12) United States Patent
Horanoff

(10) Patent No.: US 8,887,431 B2
(45) Date of Patent: Nov. 18, 2014

(54) GUN LOCK WITH RESETTABLE COMBINATION

(71) Applicant: Eugene Victor Horanoff, Jupiter, FL (US)

(72) Inventor: Eugene Victor Horanoff, Jupiter, FL (US)

( * ) Notice: Subject to any disclaimer, the term of this patent is extended or adjusted under 35 U.S.C. 154(b) by 0 days.

(21) Appl. No.: 14/247,753

(22) Filed: Apr. 8, 2014

(65) Prior Publication Data

US 2014/0305018 A1 Oct. 16, 2014

Related U.S. Application Data

(60) Provisional application No. 61/853,503, filed on Apr. 8, 2013.

(51) Int. Cl.
*F41A 17/04* (2006.01)

(52) U.S. Cl.
CPC ..... *F41A 17/04* (2013.01)
USPC ..... 42/70.11; 42/70.01; 42/70.02; 70/288

(58) Field of Classification Search
CPC ..... F41A 17/00; F41A 17/04
USPC ..... 42/70.01, 70.02, 70.11; 70/287–288, 70/304–306, 327–328
See application file for complete search history.

(56) References Cited

U.S. PATENT DOCUMENTS 4,987,693 A 1/1991 Brooks
5,090,148 A 2/1992 Brooks
5,140,766 A 8/1992 Brooks
5,229,532 A 7/1993 Brooks
5,335,521 A 8/1994 Brooks
5,408,777 A 4/1995 Brooks
5,457,907 A 10/1995 Brooks
5,732,497 A 3/1998 Brooks
5,749,166 A 5/1998 Brooks
5,782,029 A 7/1998 Brooks
5,974,717 A 11/1999 Brooks
5,987,796 A 11/1999 Brooks
6,125,568 A * 10/2000 Granaroli ..... 42/70.11
2005/0011100 A1* 1/2005 Fluhr ..... 42/70.08

* cited by examiner

*Primary Examiner* — Daniel J Troy
*Assistant Examiner* — Benjamin Gomberg
(74) *Attorney, Agent, or Firm* — Novak Druce Connolly Bove + Quigg LLP

(57) ABSTRACT

A gun lock includes engagement structure for engaging the firing mechanism to prevent operation of the firearm. A plurality of rotatable ratchet wheels are provided and a combination disk is engaged to, disengageable from, and rotatable with an associated ratchet wheel. Movable cage structure includes a plurality of keys and each combination disk has an associated key-way, the keys being moveable into the key-ways upon the movement of the ratchet wheels and associated combination disk to an unlocking position. A combination-entering member is associated with each ratchet wheel. A combination-changing member is operable to disengage the combination disks from the ratchet wheels to permit relative movement there between, and thereby relative movement of the key-way of the combination disk relative to the initial position of the associated ratchet wheel to effect changing of the combination of operations of the combination-entering members required to unlock the lock and operate the firearm.

16 Claims, 30 Drawing Sheets

GUN LOCK WITH RESETTABLE COMBINATION

CROSS REFERENCE TO RELATED APPLICATIONS

This application claims the benefit of Provisional Application Ser. No. 61/853,503 entitled "FOUR BUTTON COMBINATION GUN MAGAZINE LOCK THAT THE USER CAN EASILY CHANGE THE COMBINATION. THE GUN CAN ONLY BE FIRED BY SOMEONE WHO KNOWS THE COMBINATION, IF THE GUN LOCK IS LOCKED", filed Apr. 8, 2013, which is herein incorporated by reference in its entirety.

BACKGROUND OF THE INVENTION

The invention relates generally to gun locks, and more particularly to combination gun locks.

FIELD OF THE INVENTION

Gun locks are known to be an effective way to prevent unauthorized operation of the firearm. Combination gun locks are desirable because in an emergency there may not be time to locate a key or other lock opening device. Electronic locks suffer from the need for batteries and charging, as well as the risk of electronic failure in an emergency situation. Combination gun locks that are fixed to or integral with the firearm are particularly desirable because the lock moves with the firearm and is always available, and does not have to be physically removed from the firearm to operate the firearm. Examples of combination gun locks that are integral with the firearm can be found in U.S. Pat. Nos. 4,987,693, 5,090,148, 5,140,766, 5,229,532, 5,335,521, 5,408,777, 5,732,497, 5,782,029, 5,749,166, 5,974,717, and 5,987,796. The disclosures of these references are incorporated fully by reference.

SUMMARY OF THE INVENTION

A gun lock for locking firearms having a firing mechanism includes fastening structure for securing the lock to a portion of the firearm. Engagement structure is provided for engaging at least a portion of the firing mechanism and has a first position preventing operation of the firearm and a second position permitting operation of the firearm. A plurality of rotatable ratchet wheels each has a biasing member associated therewith for urging the ratchet wheel to an initial position. A combination disk is engaged to and rotatable with an associated ratchet wheel. Each combination disk is disengageable from the associated ratchet wheel. Movable cage structure includes a plurality of keys and each combination disk includes an associated key-way. The keys are moveable into the key-ways upon the movement of the ratchet wheels and associated combination disk to a unlocking position wherein the key-ways are aligned with the associated keys. The engagement structure is attached to the cage, and thereby moves to the second position permitting operation of the firearm.

A combination-entering member is associated with each ratchet wheel. Operation of the combination-entering member causes the corresponding ratchet wheel to rotate a predetermined angular amount with each operation of the associated combination-entering member. A combination-changing member is operable to disengage the combination disks from the associated ratchet wheels to permit relative movement of the combination disks with the associated ratchet wheels, and thereby relative movement of the key-way of the combination disk relative to the initial position of the associated ratchet wheel. Upon reengagement of the combination disks with the associated ratchet wheels this will change the combination of operations of the combination-entering members required to align the key-ways of the associated combination disks and ratchet wheels with the keys of the movable cage structure to unlock the lock and operate the firearm.

The gun lock can further include a pawl associated with and engaged to the ratchet wheel for retaining the ratchet wheel against the bias of the biasing member. A pawl reset slide can be provided for contacting the pawls and moving the pawls out of engagement with the associated ratchet wheel. The ratchet wheels can include an initializing stop.

A reset button can be attached to the cage. Movement of the reset button can act to move the keys out of the key-ways and the pawls out of contact with the ratchet wheels to permit rotation of the combination disks and the associated ratchet wheels and the engagement member to the first position to lock the gun lock. The movement of the reset button can move the pawl reset slide. The pawl rest slide can have tabs for engaging the pawls to move the pawls out of engagement with the ratchet wheels. A reset lever can be provided such that movement of the reset button moves the reset lever and causes the reset lever to contact the pawl reset slide, whereby the pawl reset slide will be moved and the tabs will be caused to engage the pawls.

The firing mechanism engagement structure can be operatively connected at one end thereof to the cage. The gun lock can include biasing structure for urging the combination disks and ratchet wheels into engagement. A combination disk reset slide can urge the combination disks out of engagement with the ratchet wheels. An adjusting screw can be engaged to the combination disk reset slide, such that rotation of the adjusting screw moves the combination disk reset slide to urge the combination disks out of engagement with the ratchet wheels.

The ratchet wheels and combination disks can have cooperating engagement teeth and grooves for detachably engaging the ratchet wheels to the combination disks. The ratchet wheels and combination disks can be rotatably mounted on shafts. Two shafts can be provided, and each shaft can have two or more cooperating combination disk and ratchet wheel pairs.

Indexing pawls can be provided for rotating the ratchet wheels against the biasing of the biasing member. Cooperating push buttons can be utilized for moving the indexing pawls.

The gun lock can be provided on a magazine clip. The gun lock can provided on a hand grip. The gun lock can be provided in any suitable location on the gun.

A method for locking a gun having a firing mechanism includes the step of providing a gun lock fastened to a portion of the firearm and comprising engagement structure for engaging at least a portion of the firing mechanism and having a first position preventing operation of the firearm and having a second position permitting operation of the firearm, the gun lock being a combination lock, the combination lock comprising structure for permitting the changing of the combination required to unlock the lock and cause the engagement structure to move from the first position preventing operation of the firearm to the second position permitting operation of the firearm. The combination lock can be operated to lock and unlock the gun using a first combination for the combination lock. The combination required to lock and unlock the combination lock can then be changed.

A gun lock can include engagement structure for engaging at least a portion of the firing mechanism. The gun lock has a first position preventing operation of the firearm and has a second position permitting operation of the firearm. The gun lock is a combination lock having key structure for moving into corresponding key-way structure upon entry of the combination. The engagement structure and the key structure are operatively attached to a pivoting reversing lever. The engagement structure is attachable to the reversing lever at a plurality of locations and the reversing lever is pivotal about a plurality of attachment points. In one connection the engagement structure moves in the same direction as the key structure upon opening of the lock. In another connection the engagement structure moves in the opposite direction as the key structure upon opening of the lock.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
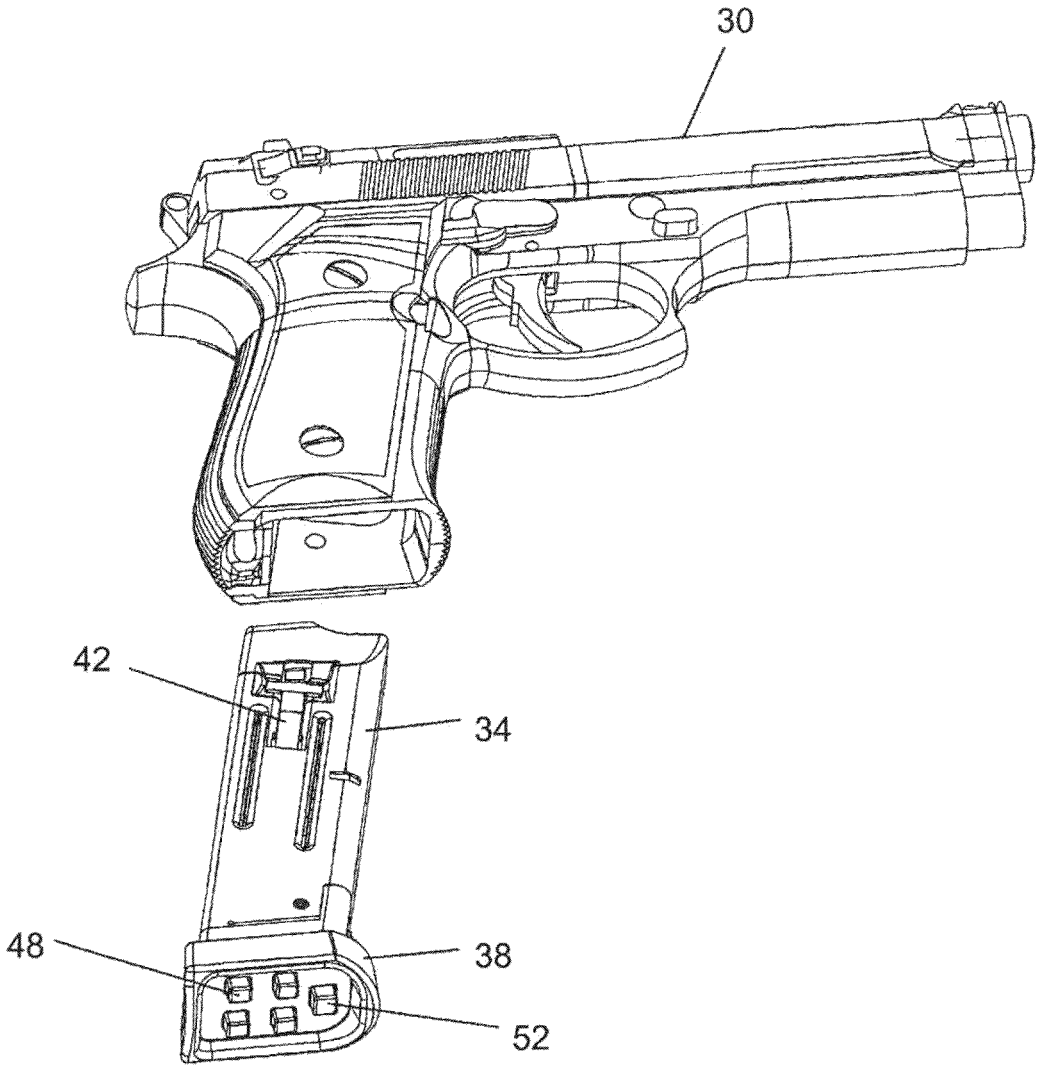
FIG. 1 is a perspective view of a handgun having a gun lock according to one aspect of the invention.
Figure 2:
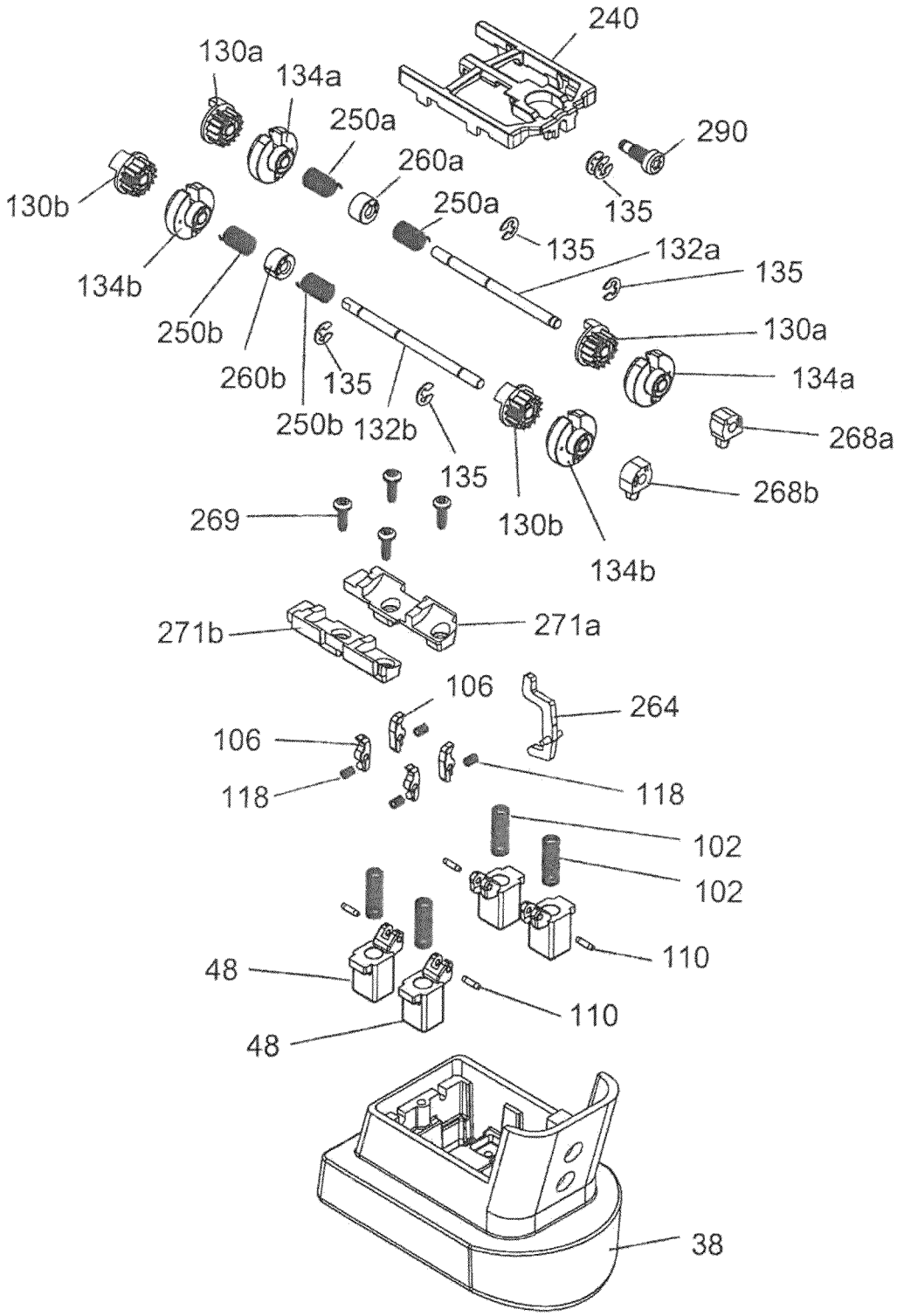
FIG. 2 (*a-c*) is an exploded perspective of a gun lock according to the invention.
Figure 2:
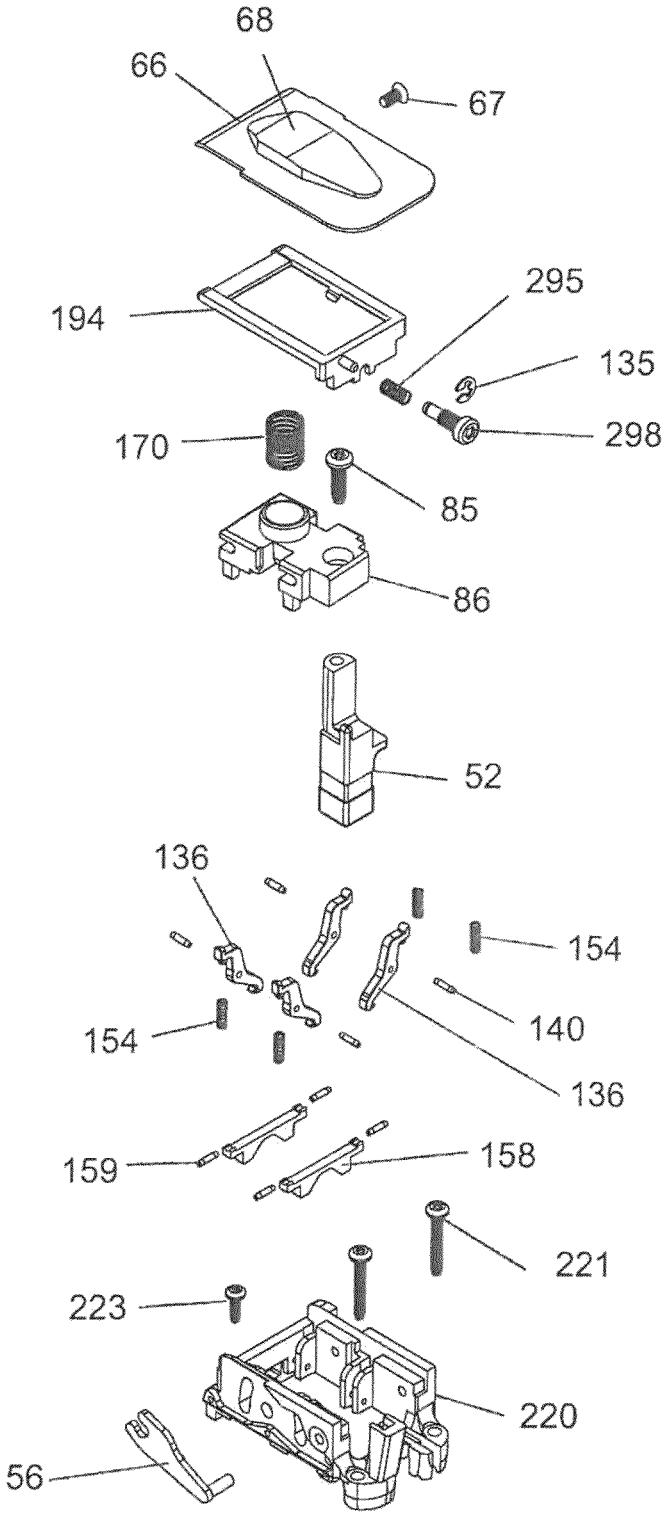
Figure 2:
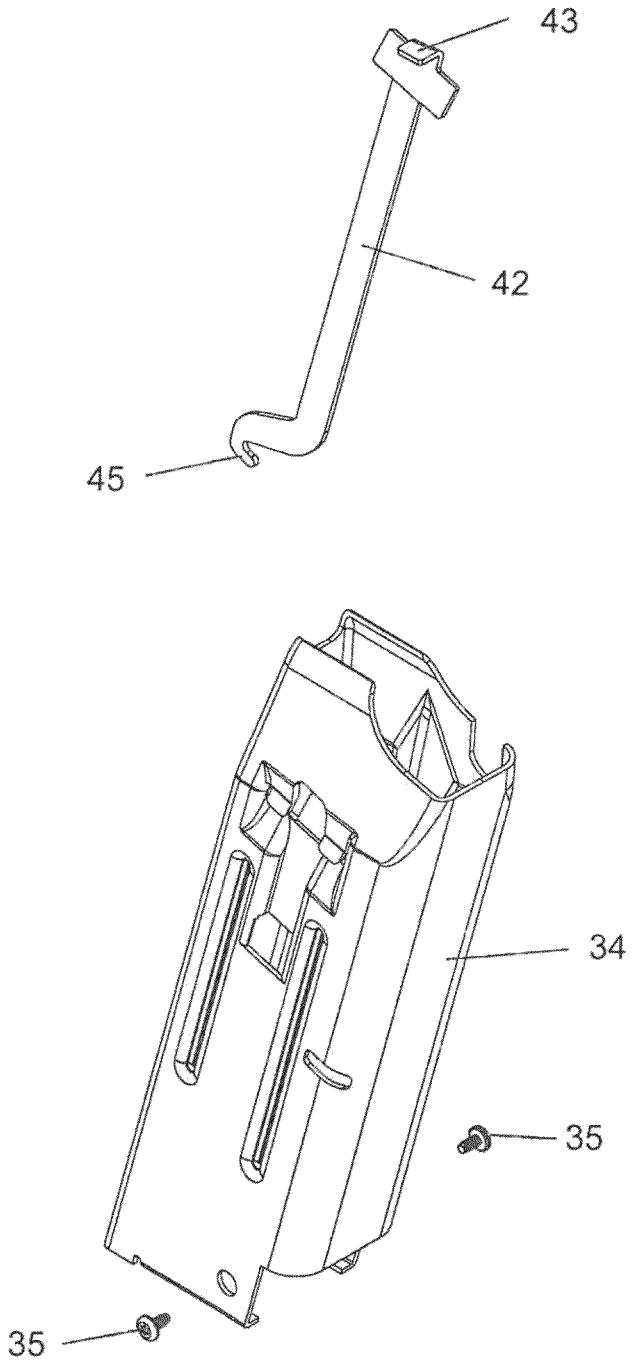

A gun lock for locking firearms having a firing mechanism includes fastening structure for securing the lock to a portion of the firearm. Engagement structure is provided for engaging at least a portion of the firing mechanism and has a first position preventing operation of the firearm and a second position permitting operation of the firearm. A plurality of rotatable ratchet wheels each has a biasing member associated therewith for urging the ratchet wheel to an initial position. A combination disk is engaged to and rotatable with an associated ratchet wheel. Each combination disk is disengageable from the associated ratchet wheel. Movable cage structure includes a plurality of keys or posts and each combination disk includes an associated key-way or slot. The cage can be any suitably shaped structure. The posts are moveable into the key-ways upon the movement of the ratchet wheels and associated combination disk to a unlocking position wherein the key-ways are aligned with the associated keys. The engagement structure is attached to the cage, and thereby moves to the second position permitting operation of the firearm.

A combination-entering member is associated with each ratchet wheel. Operation of the combination-entering member causes the corresponding ratchet wheel to rotate a predetermined angular amount with each operation of the associated combination-entering member. A combination-changing member is operable to disengage the combination disks from the associated ratchet wheels to permit relative movement of the combination disks with the associated ratchet wheels, and thereby relative movement of the key-way of the combination disk relative to the initial position of the associated ratchet wheel. Upon reengagement of the combination disks with the associated ratchet wheels this will change the combination of operations of the combination-entering members required to align the key-ways of the associated combination disks and ratchet wheels with the keys of the movable cage structure to unlock the lock and operate the firearm.

The gun lock can further include a pawl associated with and engaged to the ratchet wheel for retaining the ratchet wheel against the bias of the biasing member. A pawl reset slide can be provided for contacting the pawls and moving the pawls out of engagement with the associated ratchet wheel. The ratchet wheels can include an initializing stop.

A reset button can be attached to the cage. Movement of the reset button can act to move the keys out of the key-ways and the pawls out of contact with the ratchet wheels to permit rotation of the combination disks and the associated ratchet wheels and the engagement member to the first position to lock the gun lock. The movement of the reset button can move the pawl reset slide. The pawl rest slide can have tabs for engaging the pawls to move the pawls out of engagement with the ratchet wheels. A reset lever can be provided such that movement of the reset button moves the reset lever and causes the reset lever to contact the pawl reset slide, whereby the pawl reset slide will be moved and the tabs will be caused to engage the pawls.

The firing mechanism engagement structure can be operatively connected at one end thereof to the cage. The gun lock can include biasing structure for urging the combination disks and ratchet wheels into engagement. A combination disk reset slide can urge the combination disks out of engagement with the ratchet wheels. An adjusting screw can be engaged to the combination disk reset slide, such that rotation of the adjusting screw moves the combination disk reset slide to urge the combination disks out of engagement with the ratchet wheels.

The ratchet wheels and combination disks can have cooperating engagement teeth and grooves for detachably engaging the ratchet wheels to the combination disks. The ratchet wheels and combination disks can be rotatably mounted on shafts. Two shafts can be provided, and each shaft can have two or more cooperating combination disk and ratchet wheel pairs.

Indexing pawls can be provided for rotating the ratchet wheels against the biasing of the biasing member. Cooperating push buttons can be utilized for moving the indexing pawls.

The gun lock can be provided on a magazine clip. The gun lock can provided on a hand grip. The gun lock can be provided in any suitable location on the gun.

A gun lock can include engagement structure for engaging at least a portion of the firing mechanism. The gun lock has a first position preventing operation of the firearm and having a second position permitting operation of the firearm. The gun lock is a combination lock having key structure for moving into corresponding key-way structure upon entry of the combination. The engagement structure and the key structure are operatively attached to a pivoting reversing lever. The engagement structure is attachable to the reversing lever at a plurality of locations and the reversing lever is pivotal about a plurality of attachment points. In one connection the engagement structure moves in the same direction as the key structure upon opening of the lock. In another connection the engagement structure moves in the opposite direction as the key structure upon opening of the lock.

Gun locks according to the invention are shown in FIGS. 1-31. The gun locks of the invention are suitable for virtually any type of firearm, such as the pistol 30 (Beretta USA, Accokeek Md.). The gun lock can be provided anywhere on the gun but in the embodiment shown is provided in a magazine 34 that can function in the usual manner for the magazine. The gun lock housing 38 is provided at the base of the magazine 34 (FIG. 1). A locking arm 42 extends from the gun lock housing 38 to a portion of the firing mechanism (not shown) and is operable in one position to lock a portion of the firing mechanism to prevent operation of the firearm, and in another unlocked position permit operation of the firearm. The gun lock is a combination lock and includes a plurality of pushbuttons 48 which are used to enter the combination which will unlock the lock to permit operation of the firearm 30. A reset button 52 is provided to initialize the combination lock to permit entering of the combination with the pushbuttons 48.

Figure 3:
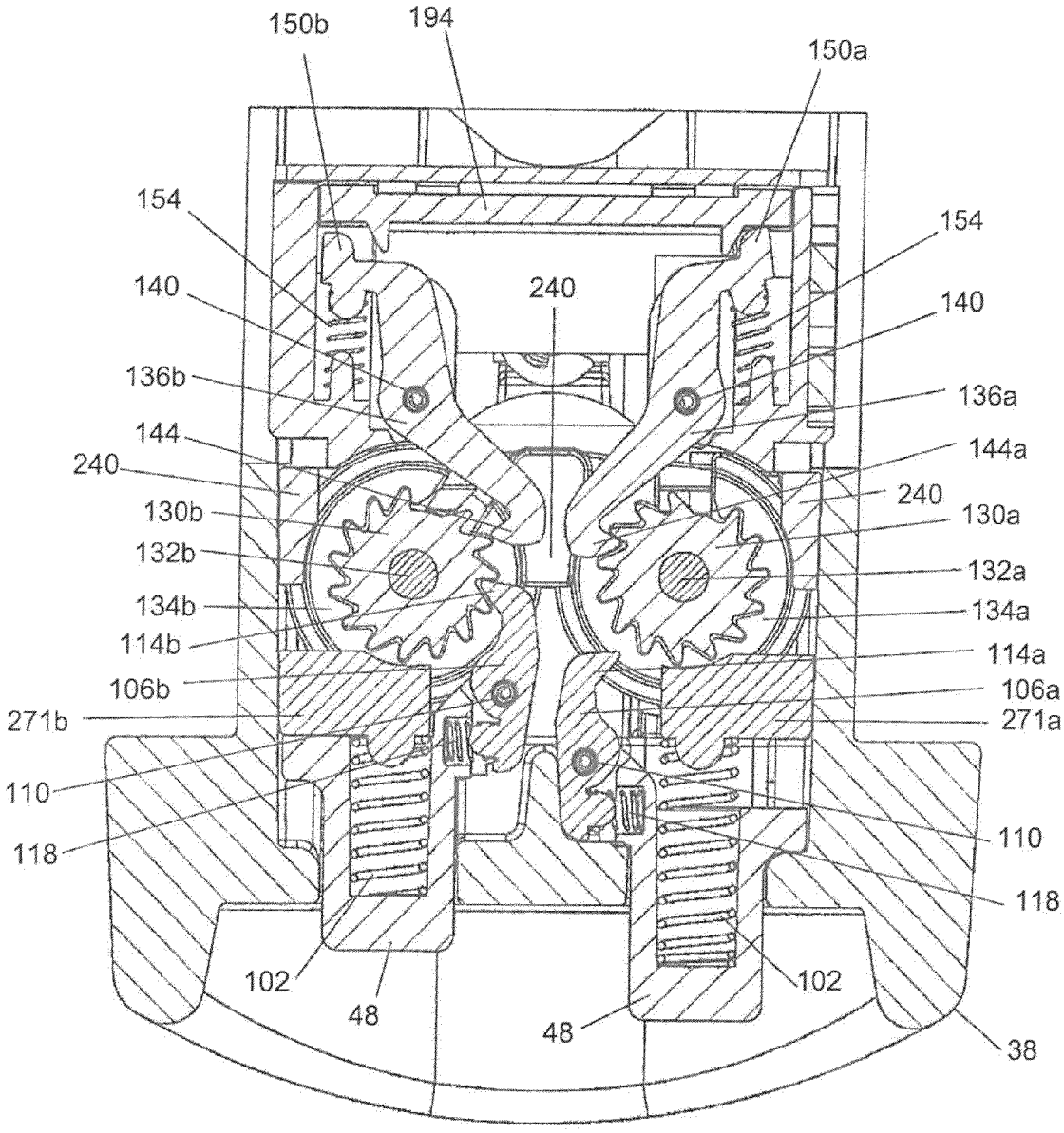
FIG. 3 is a cross-section.
Figure 4:
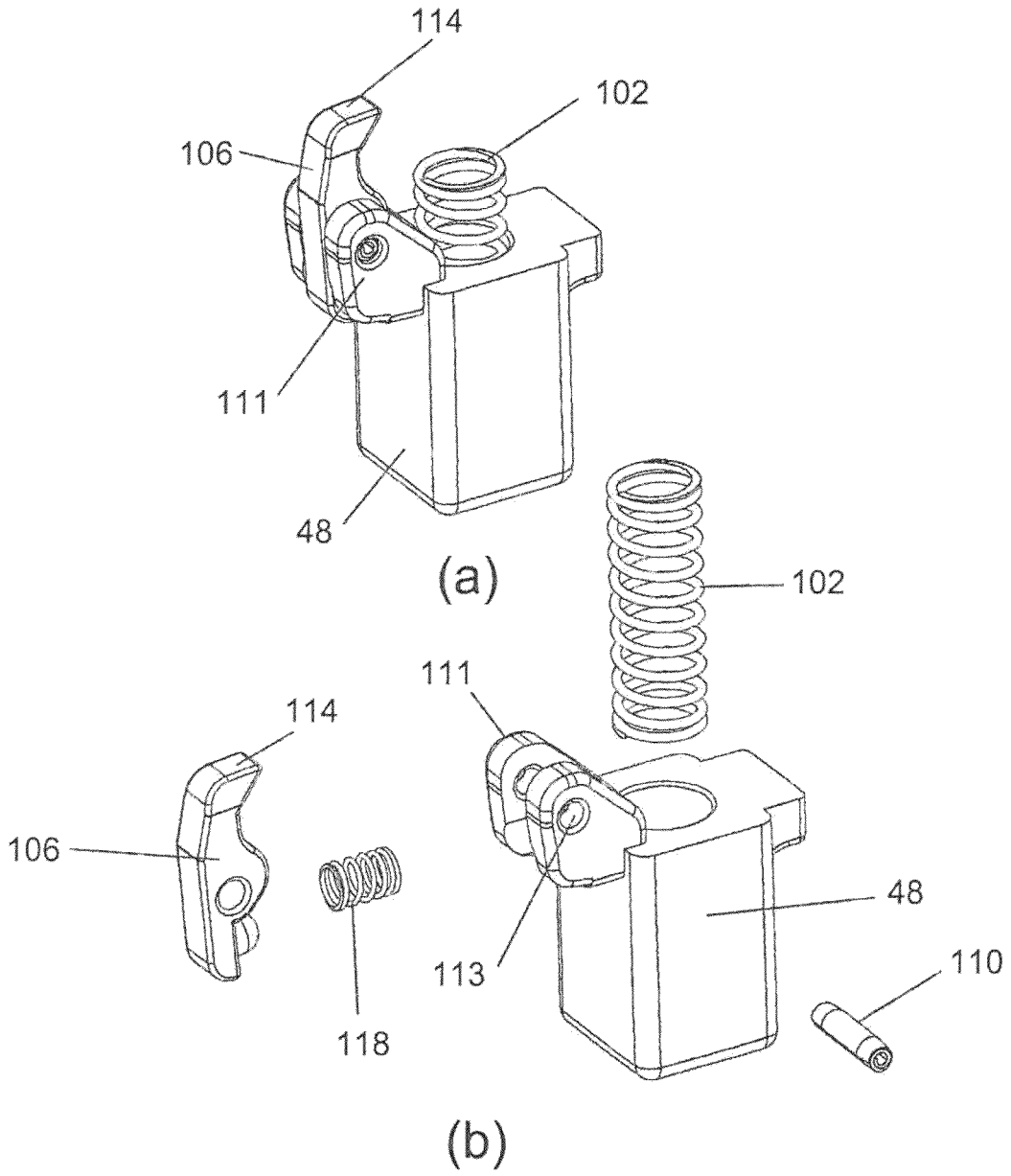
FIG. 4 (*a-b*) is (*a*) a perspective view of a push button assembly and (*b*) an exploded perspective view.

As shown more particularly in FIGS. 2-6, the pushbuttons 48 have associated pushbuttons springs 102 to bias the pushbuttons downward. An indexing pawl 106 is associated with each pushbutton 48. The indexing pawls 106 can be pivotally mounted on pins 110 extending through openings 113 and pin seats 111 (FIG. 4). The pawl head 114 cooperates with teeth on the ratchet wheel 130. An indexing pawl spring 118 urges the head 114 into engagement with the ratchet wheel 130 (FIG. 3). The ratchet wheel 130 is rotatably mounted on a shaft 132 and is disengageable with combination disk 134, which is also rotatably mounted on the shaft 132. The ratchet wheels 130 are engaged to combination disks 134. Rotation of the ratchet wheels 130 will thereby cause corresponding angular rotation of associated combination disks 134.

Retaining pawls 136 are pivotally mounted about pivot pins 140 and have retaining pawl heads 144 which engage the ratchet wheels to retain the ratchet wheel 130 in position after operation of the pushbutton 48. A distal end 150 of retaining pawl 136 is acted upon by retaining pawl spring 154 to urge the retaining pawl 136 about pivot pin 140 into engagement with the ratchet wheel 130. As shown in FIG. 3, operation of the pushbutton 48 causes the indexing pawl 106 to move from the position shown on the right to the position shown on the left indexing pawls 106. The head 114 of indexing pawl 106 engages the ratchet wheel **130*b* to rotate the ratchet wheel 130*b* about the shaft 132*b*. The retaining pawl 136 moves over the forward slope of the ratchet wheel teeth to engage the trailing slope and prevent the return of the ratchet wheel 132*b* to the original position. Upon release of the pushbutton 48, the indexing pawl 106** returns to the position shown on the right.

Figure 5:
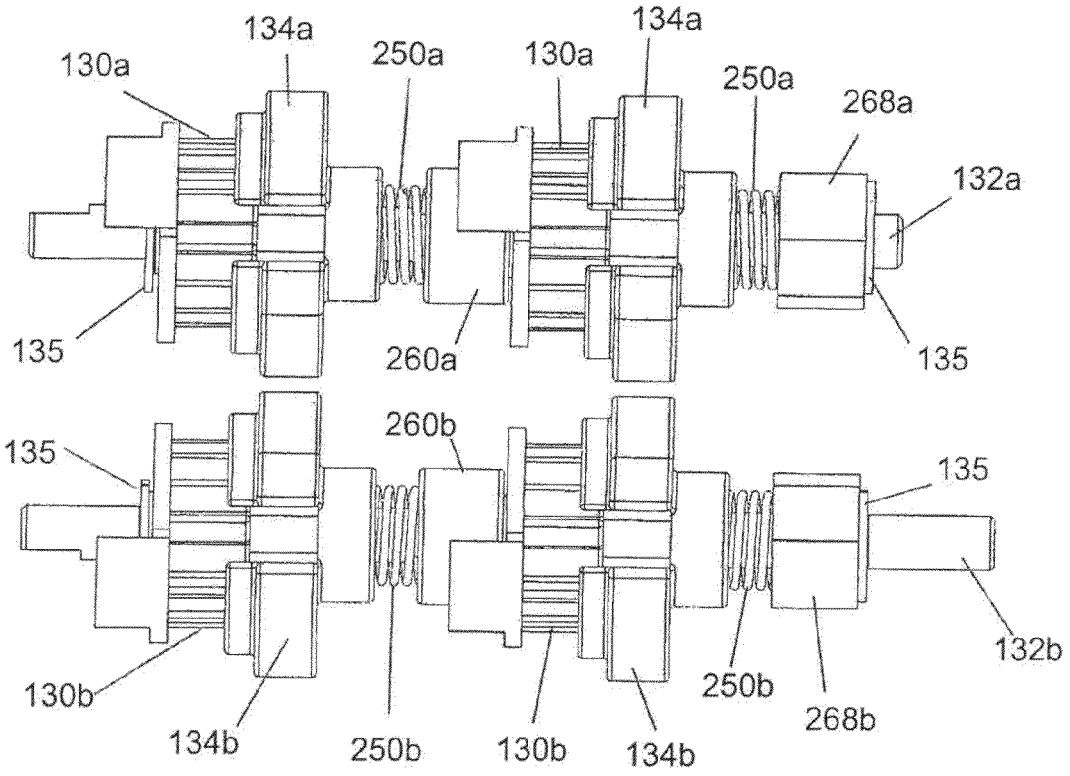
FIG. 5 is a plan view of ratchet wheel and combination disk assemblies.
Figure 6:
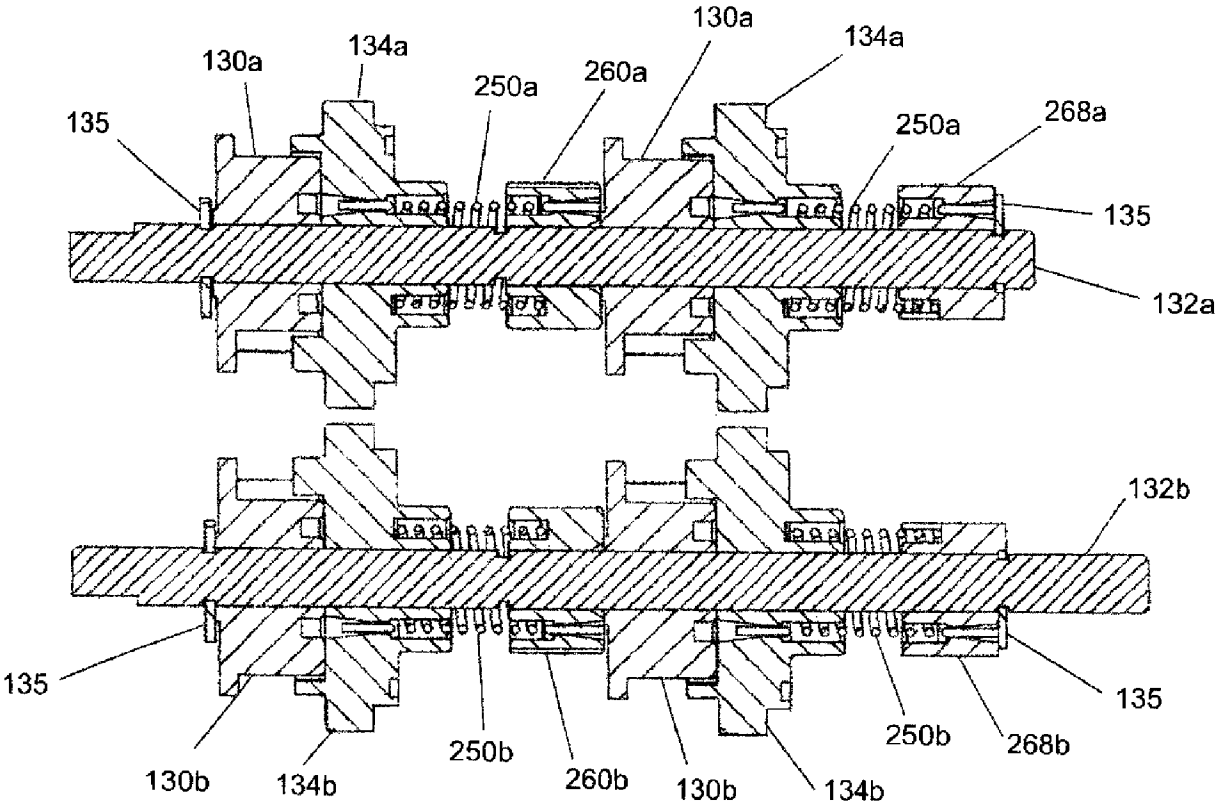
FIG. 6 is a cross-section of ratchet wheel and combination disk assemblies.

As shown in FIGS. 5-6 the ratchet wheels 130 and combination disks 134 are rotatably mounted about shafts 132. Clips 135 retain the pieces together on the shafts 132. Springs 250 urge the combination disks 134 into engagement with the ratchet wheels 130 and act to unwind the ratchet wheels 130. Spring **250*a* is oppositely wound to spring 250*b*. Shaft rings 260 retain the alignment of the ratchet wheels 130 and provide a spring seat for the springs 250. Shaft supports 268 are provided to support and position the shafts 132** within the lock.

Figure 7:
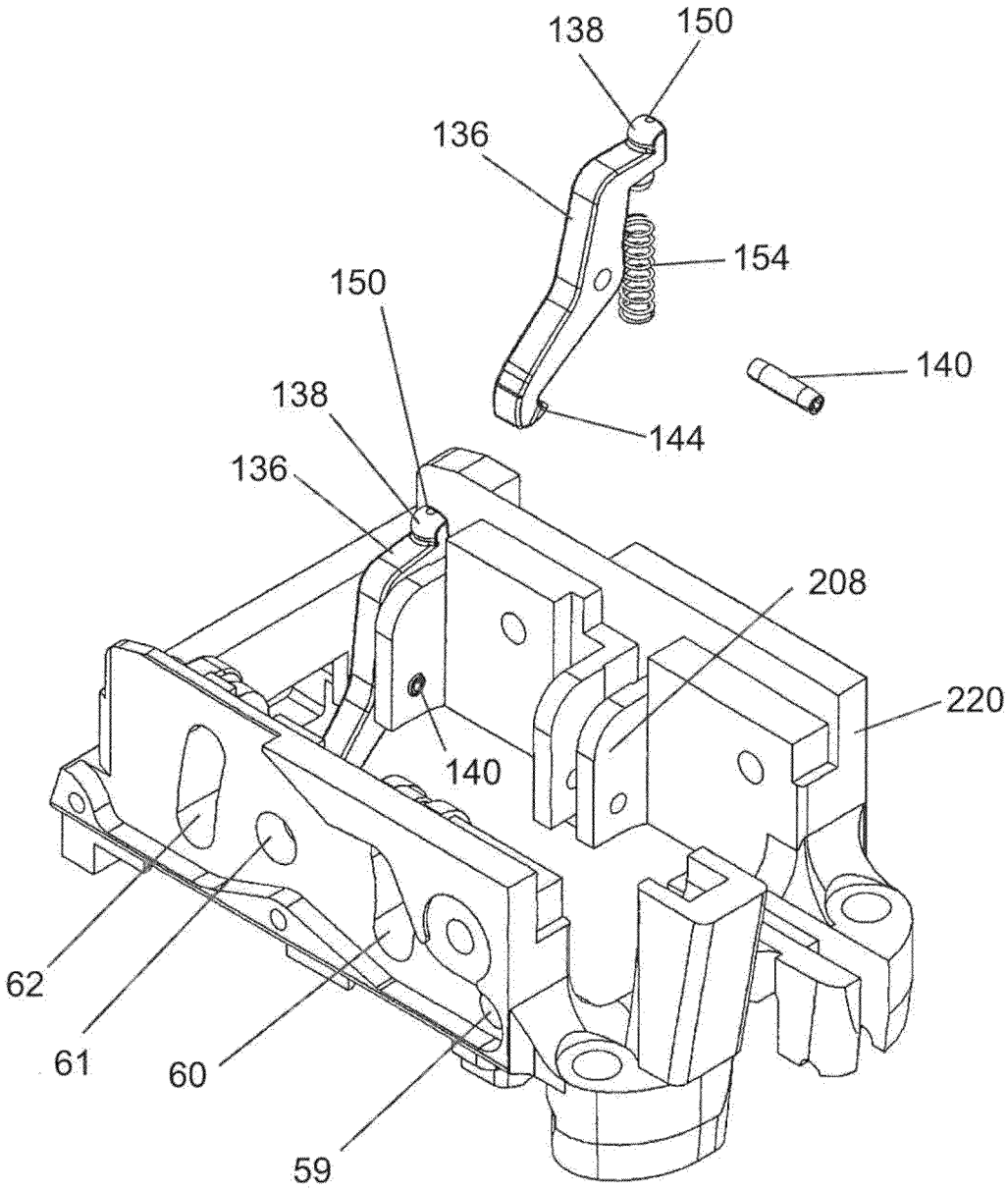
FIG. 7 is an exploded perspective view of an insert and retaining pawl assembly.

As shown in FIG. 7, the retaining pawls 136 are pivotally mounted to an insert 220 about pawl supports 208. The insert 220 can be any suitable shape. An engagement surface 138 is provided on the distal end 150 of the pawls 136 for contact by a reset slide. Retaining pawl slots 60 and 62 are provided for operation of a lever arm, to be described.

Figure 8:
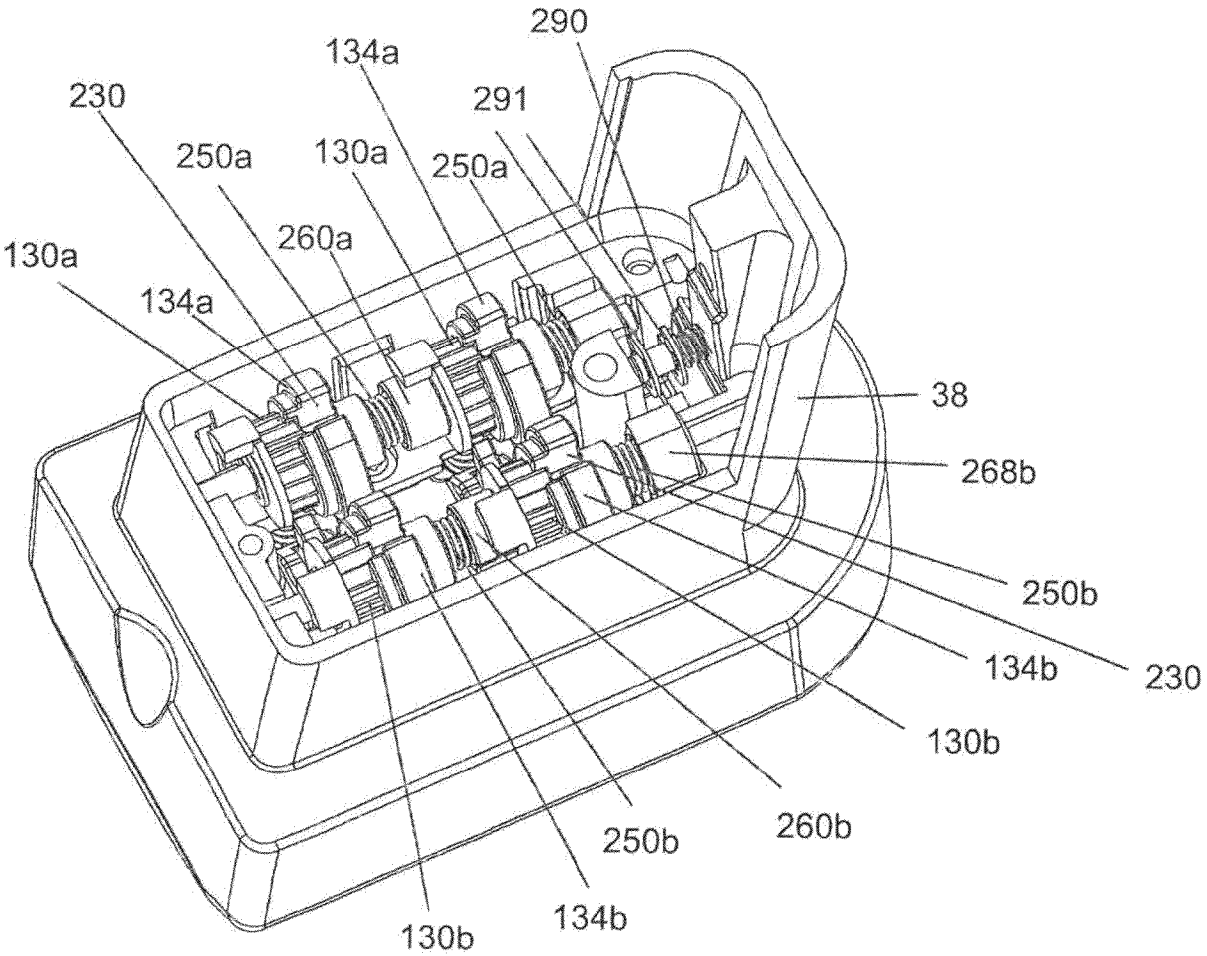
FIG. 8 is a perspective view of a gun lock according to the invention in a first stage of assembly.
Figure 9:
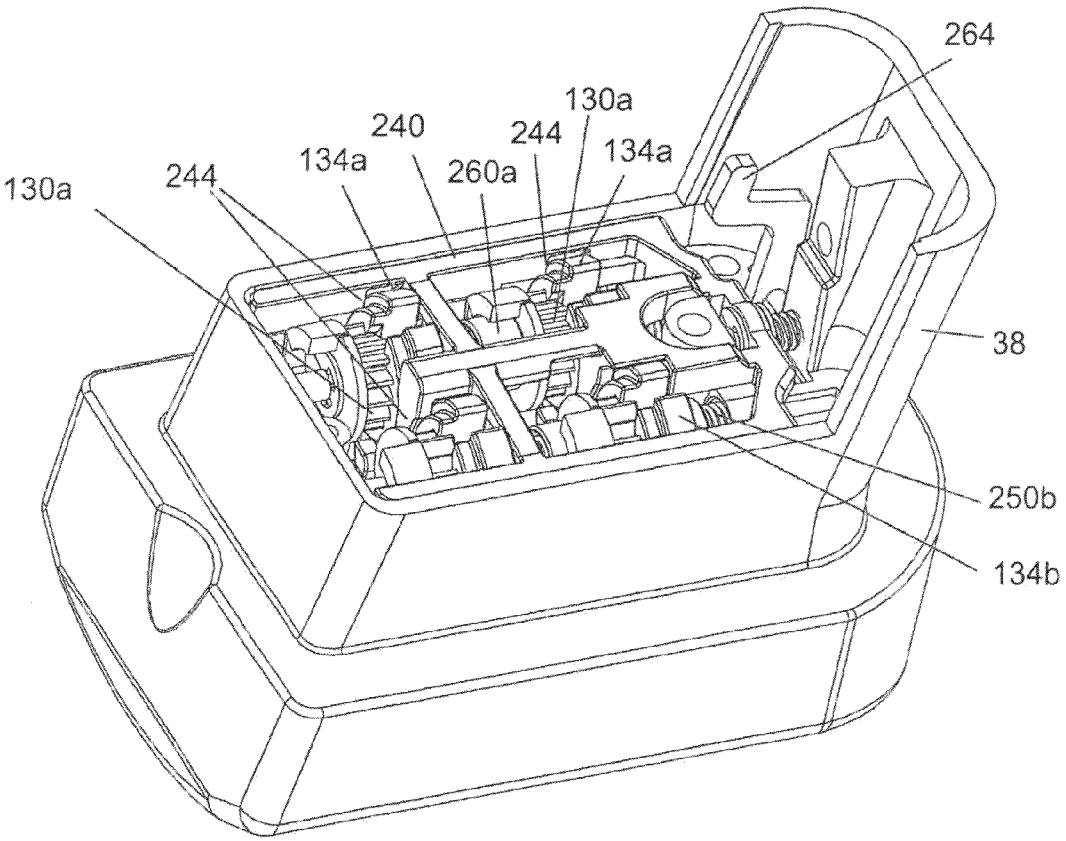
FIG. 9 is a perspective view of a gun lock in a second stage of assembly.
Figure 10:
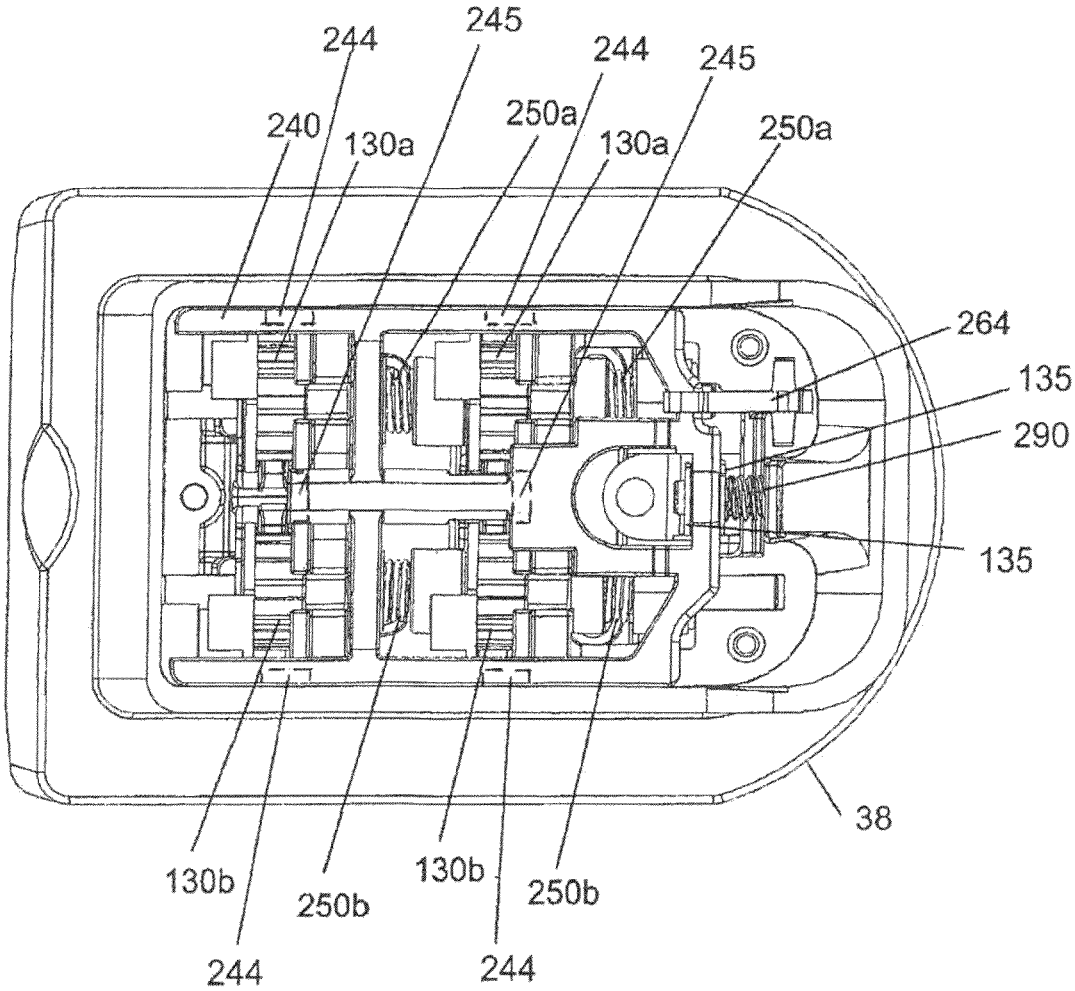
FIG. 10 is a plan view of the gun lock in the second stage of assembly.
Figure 11:
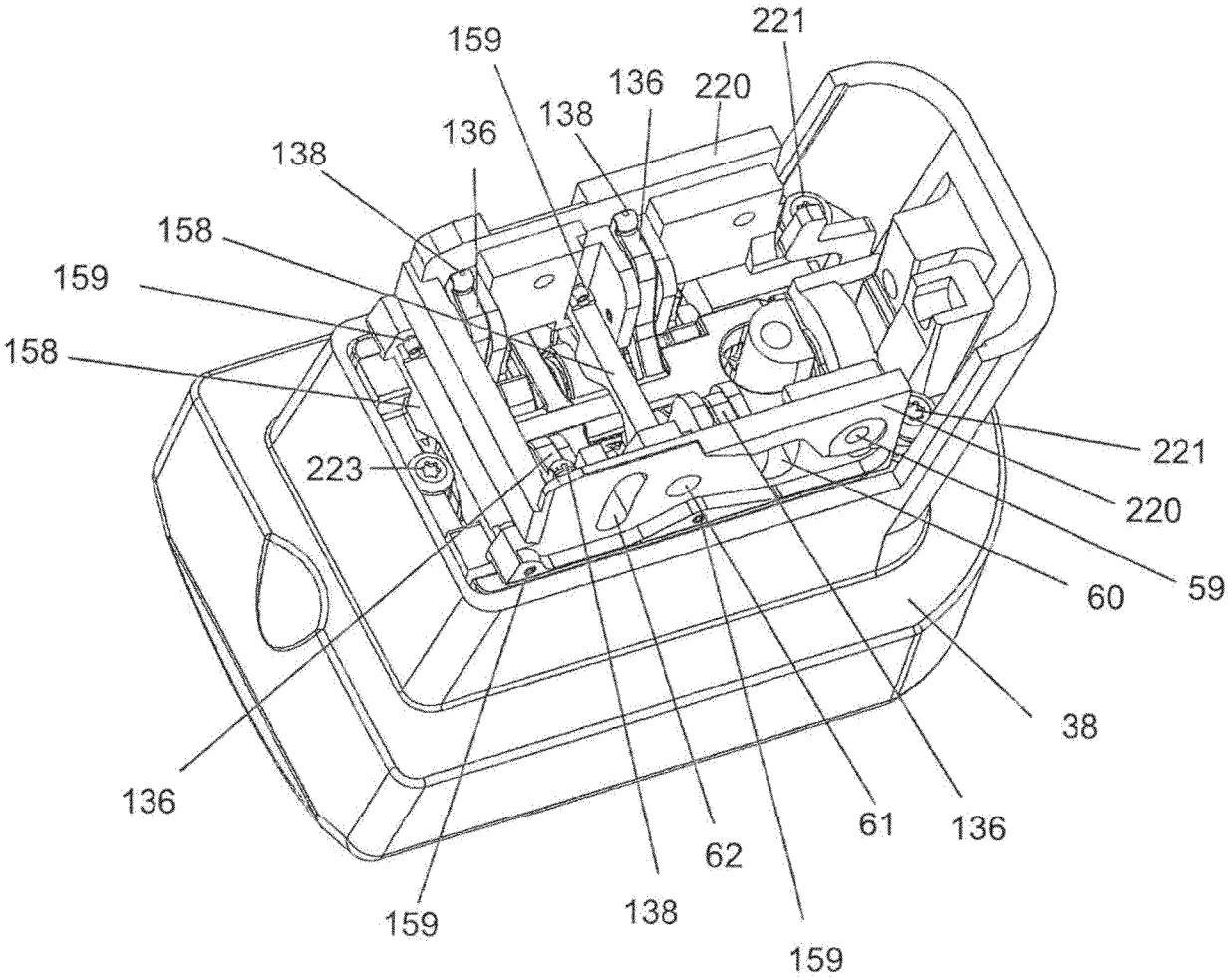
FIG. 11 is a perspective view of the gun lock in a third stage of assembly.
Figure 12:
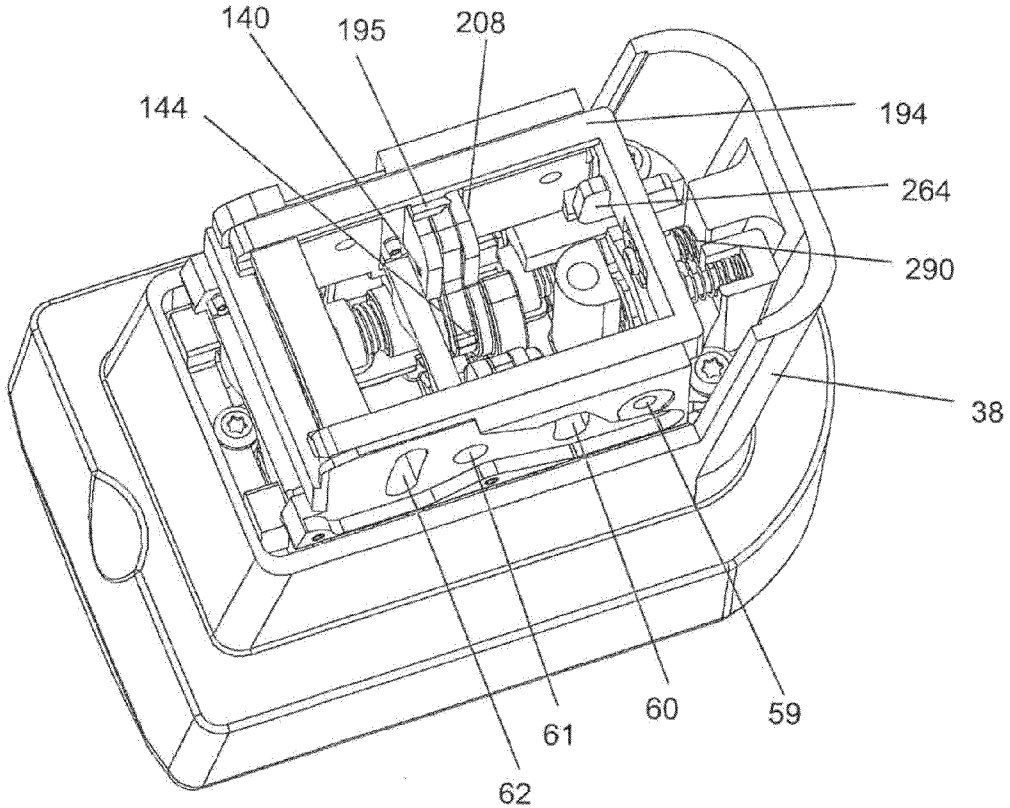
FIG. 12 is a perspective view of the gun lock in a fourth stage of assembly.
Figure 13:
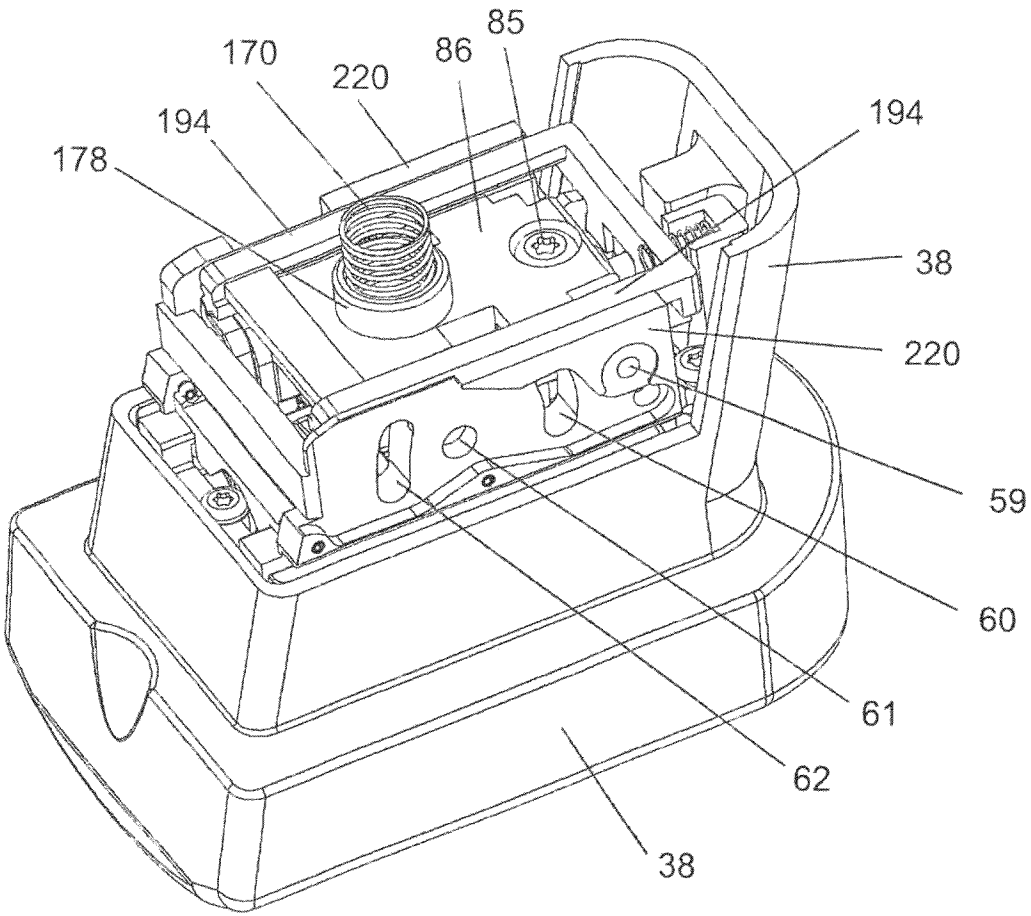
FIG. 13 is a perspective view of the gun lock in a fifth stage of the assembly.
Figure 14:
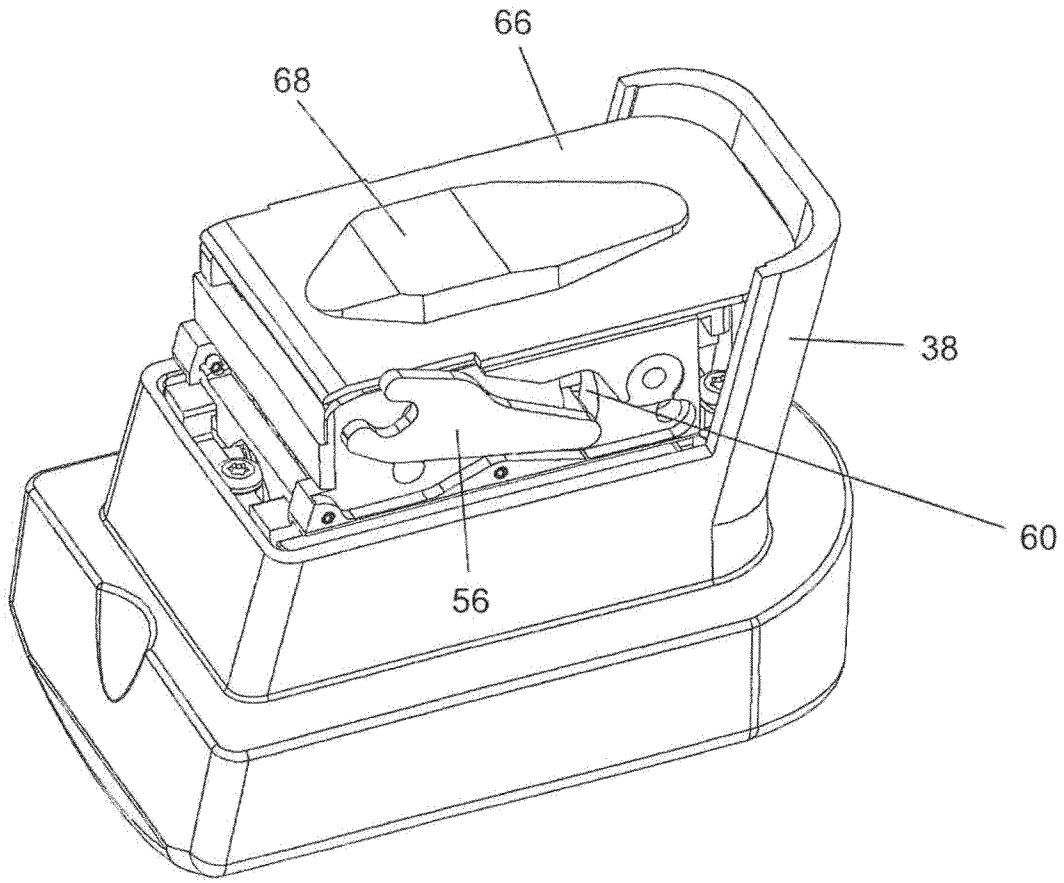
FIG. 14 is a perspective view of a gun lock in a sixth stage of assembly.

The assembly of the lock is illustrated in FIGS. 8-14. The button assemblies shown in FIG. 4 are first installed with the ratchet wheel locator 271 with screws 269. The reset button 52 is also installed. The shafts 132 bearing the ratchet wheels 130 and combination disks 134 as shown in FIGS. 5-6 are inserted into the housing 38 (FIG. 8). A combination disk reset slide 240 is positioned over the shafts 132, ratchet wheels 130 and combination disks 134 (FIGS. 9-10). A reset lever 264 is also provided. The insert 220 with retaining pawls 136 is positioned over the combination disk reset slide 240 (FIG. 11) with screws 221 and 223. A pawl reset slide 194 is positioned over the insert 220 (FIG. 12). Movable cage 86 is positioned with the posts 94 adjacent combination disks 134 such that posts 94 can move into the slots 230 upon entering the correct combination (FIG. 13). Top cover 66 is placed over the cage 86 and abuts manual safety spring 170. Slanted surface 68 of top cover 66 is provided to hold the top of spring 170 in place and allows the lock to be shorter in height than otherwise would be possible. The slanted surfaces also make it easier to install the lock in the magazine as these surfaces force the spring out of the way when the lock is slid into magazine.

Figure 15:
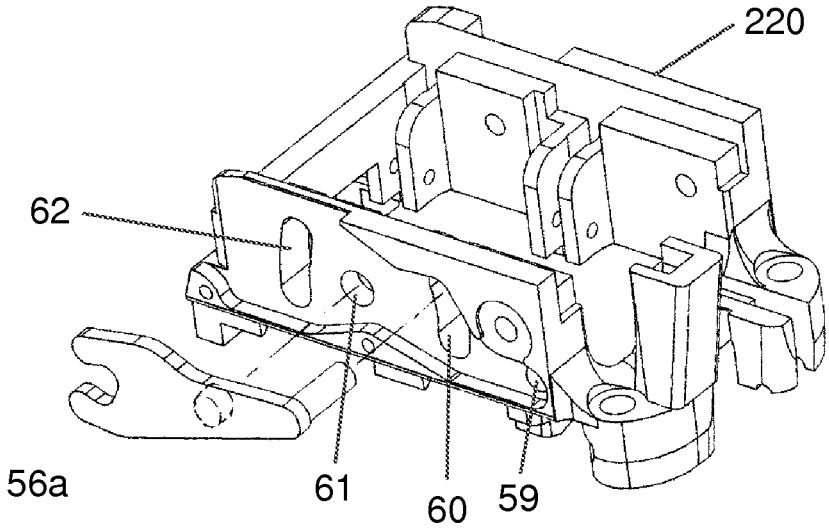
FIG. 15 is an exploded perspective view of an insert and lever.
Figure 16:
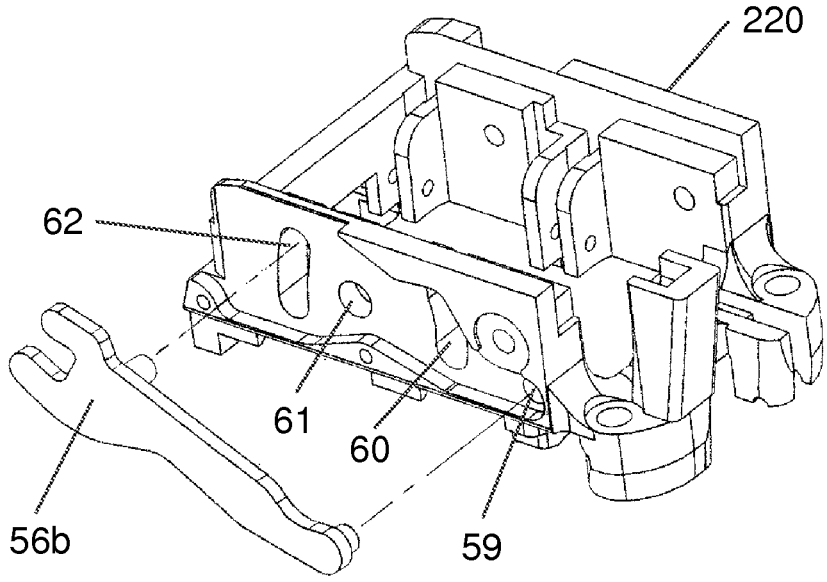
FIG. 16 is an exploded perspective view of an alternative insert and lever.
Figure 17:
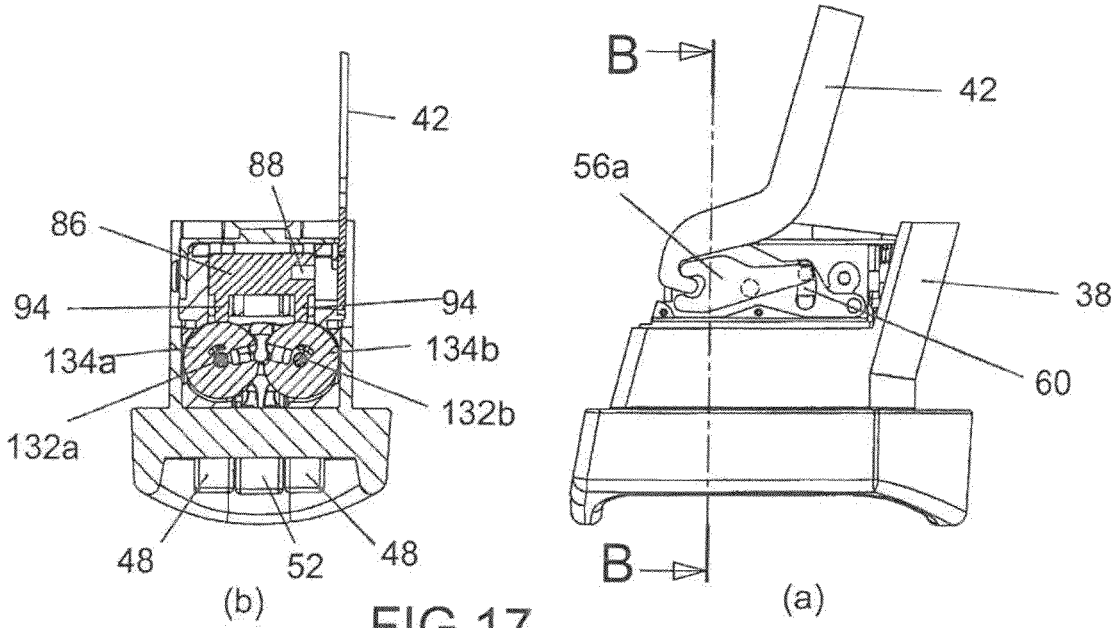
FIG. 17 is (*a*) a side elevation of a gun lock and locking arm assembly, and (*b*) a cross-section taken along line B-B in FIG. 17(*a*), in a first mode of operation.
Figure 18:
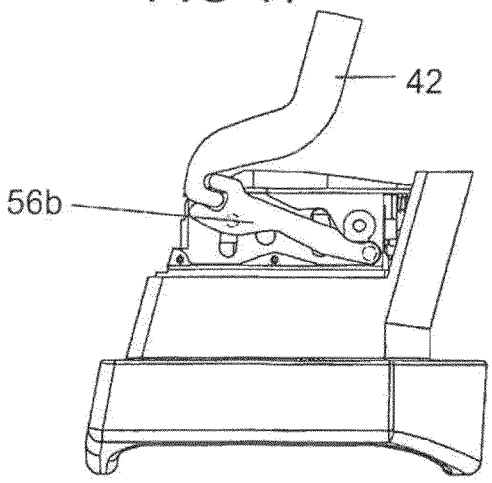
FIG. 18 is a side elevation of an alternative embodiment of a gun lock and locking arm assembly, in the first mode of operation.
Figure 19:
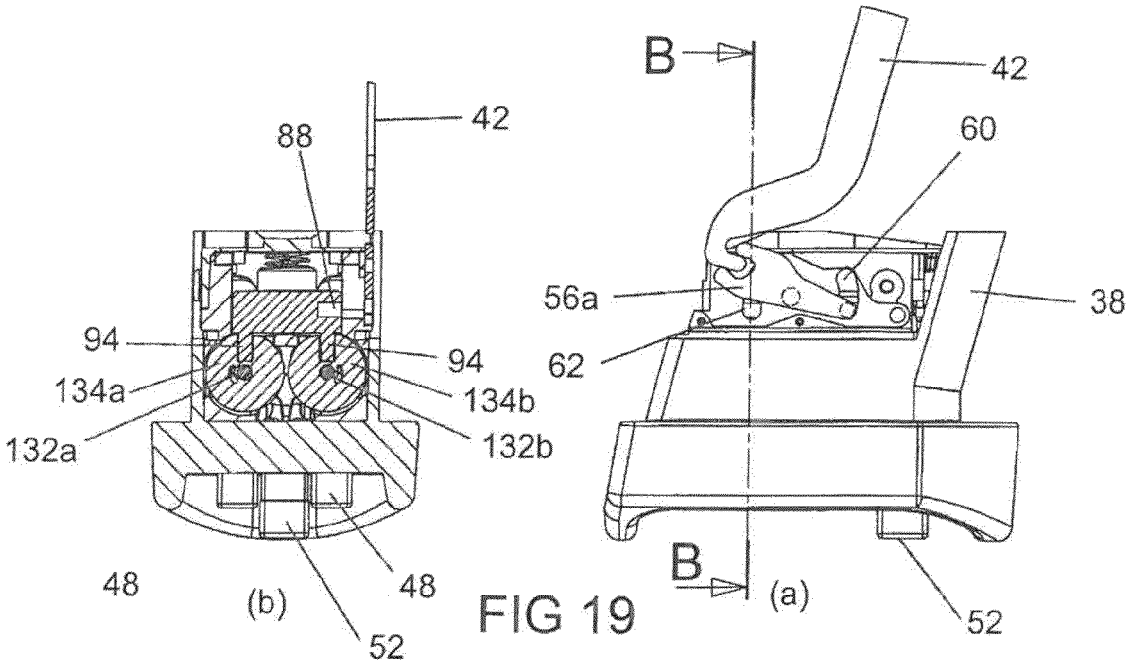
FIG. 19 is (*a*) a side elevation of a gun lock and locking arm assembly, and (*b*) a cross-section taken along line B-B in FIG. 19(*a*), in a second mode of operation.
Figure 20:
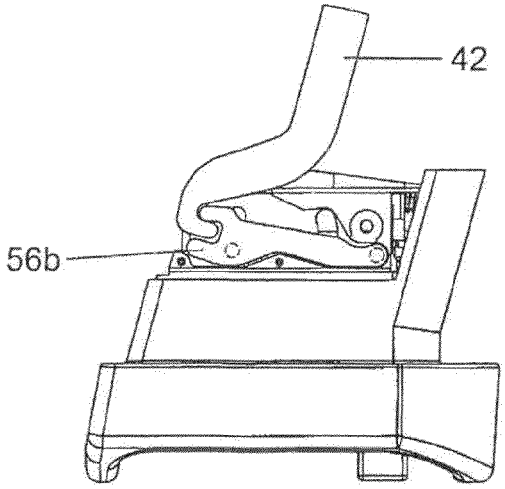
FIG. 20 is a side elevation of an alternative embodiment of a gun lock and locking arm assembly, in the second mode of operation.
Figure 21:
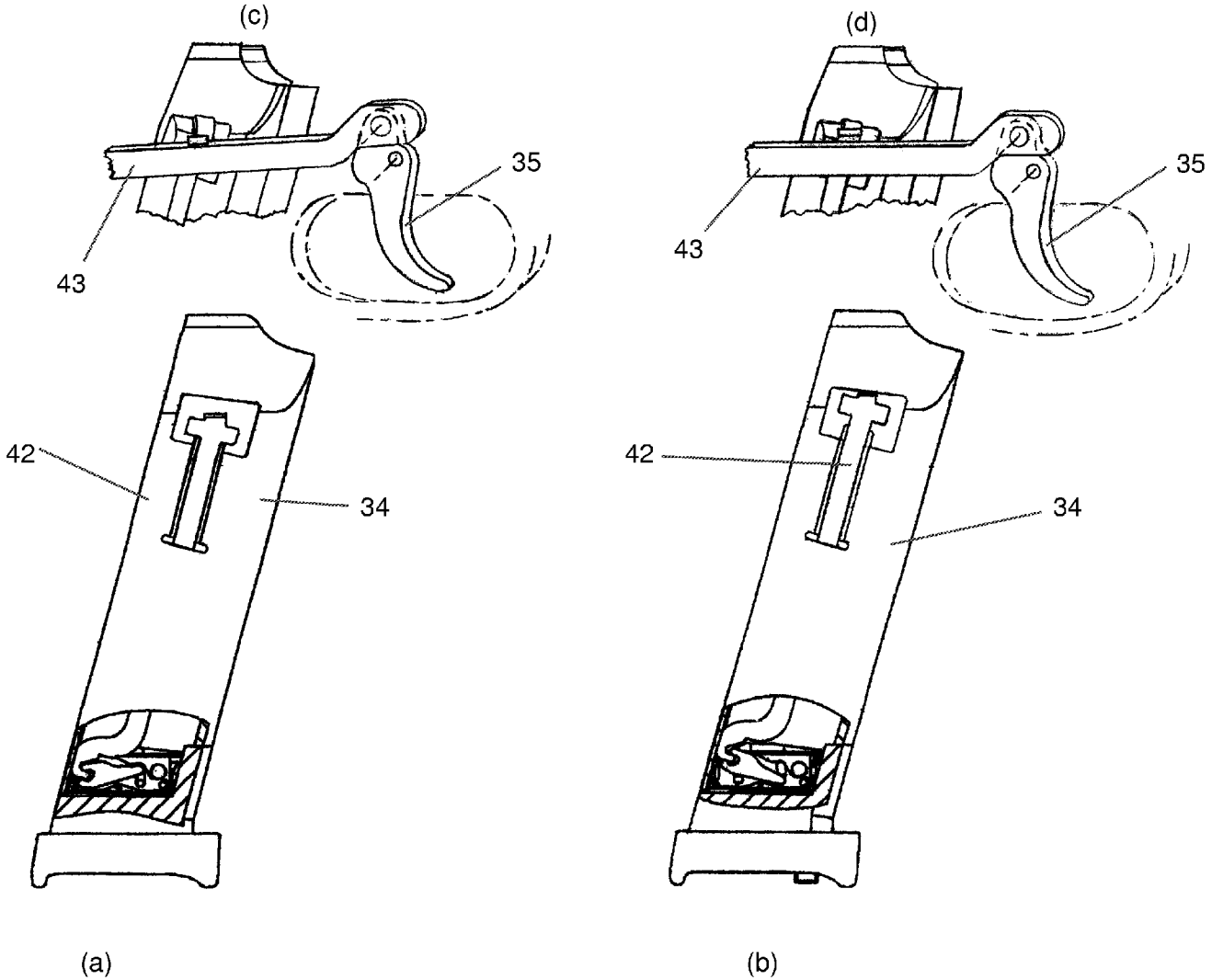
FIG. 21 (*a-b*) is a side elevation, partially broken away, of a magazine lock according to the invention in (a) first mode of operation and (b) an alternative mode of operation, and in operation with the firing mechanism of a firearm in (c) the first mode of operation and (d) the alternative mode of operation.

The operation of the gun lock can be seen in FIGS. 15-21. As shown in FIGS. 15-16, the insert 220 can be configured to accommodate different lever arms 56*a*, 56*b*. The difference in these lever arms is in the point of rotation. The lever arm 56*a* rotates about a pivot midway in the lever arm 56*a* (as for a Beretta®, Beretta USA, Accokeek Md.) positioned in a hole 61, while the lever arm 56*b* rotates about an end opposite to the point of engagement to the locking arm 42 (as for a Glock®, Glock Inc., Smyrna, Ga.) in a hole 59. Alternatively positioned slots 60 and 62 can be provided for the different designs. As shown in FIG. 17, when the lock is in the locked position the movable cage 86 is in an elevated position because the posts 94 are out of alignment with the slots 230 of the combination disks 134. The lever arm 56*a* is pivoted to a downward position of the locking arm 42. This is the position for locking firearms such as a Beretta®. The lever arm 56*b* is in an upward position due to the point of attachment to the cage 86 and the position of the pivot of the lever arm 56*b*, as would be appropriate for a firearm such as a Glock®. As shown in FIGS. 19-21, upon entering the correct combination that posts 94 are placed into alignment with the slots 230 of the combination disks 134 and the cage 86 is lowered under the action of safety spring 270. In the case of lever arm 56*a*, this will cause pivoting about the central pivot point and upward movement of the locking arm 42.

In the case of lever arm 56*b*, this will cause downward pivoting of the lever arm 56*b* and downward movement of the locking arm 42. As shown in FIG. 21 (*c-d*) the movement of the locking arm 42 will cause engagement with trigger bar 43 such that operation of the trigger 35 cannot fire the firearm.

Figure 22:
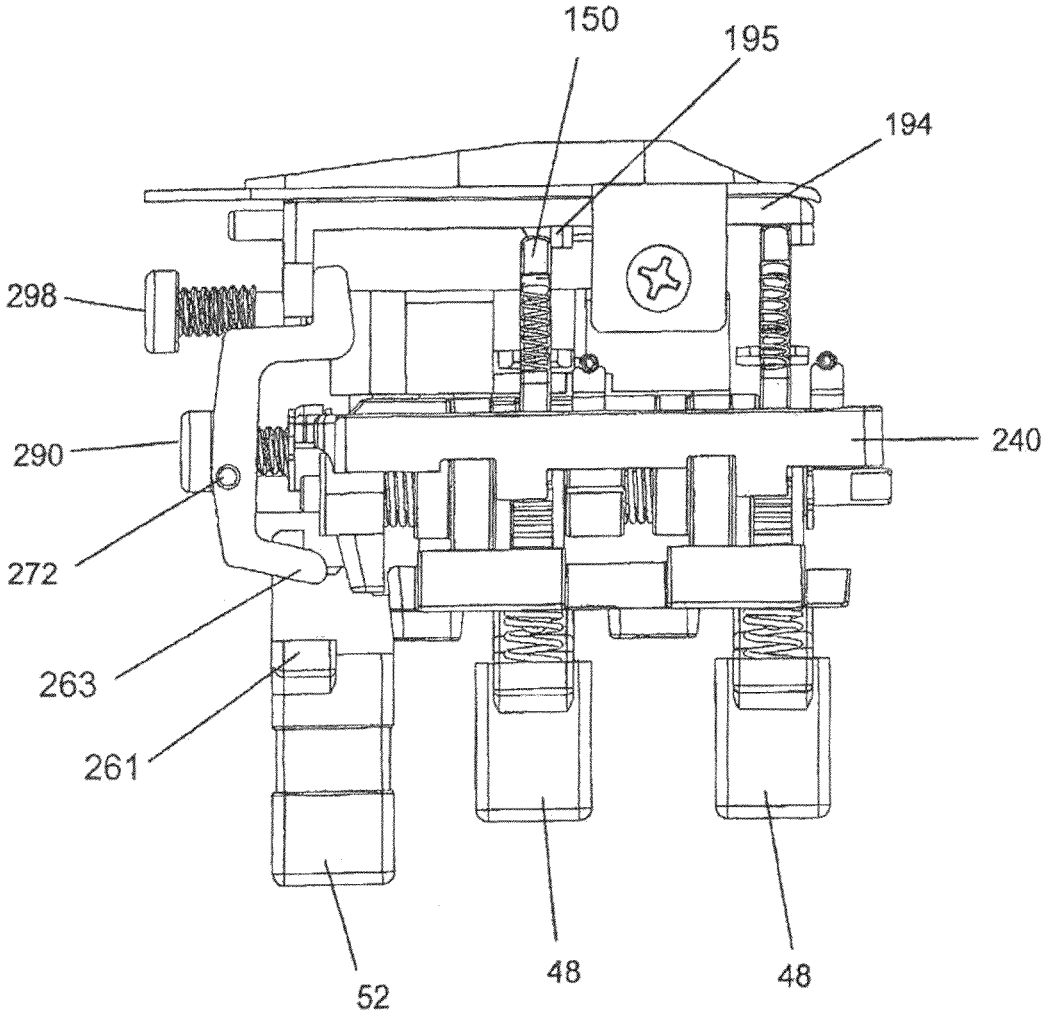
FIG. 22 is a side elevation of a gun lock assembly in a first reset mode of operation.
Figure 23:
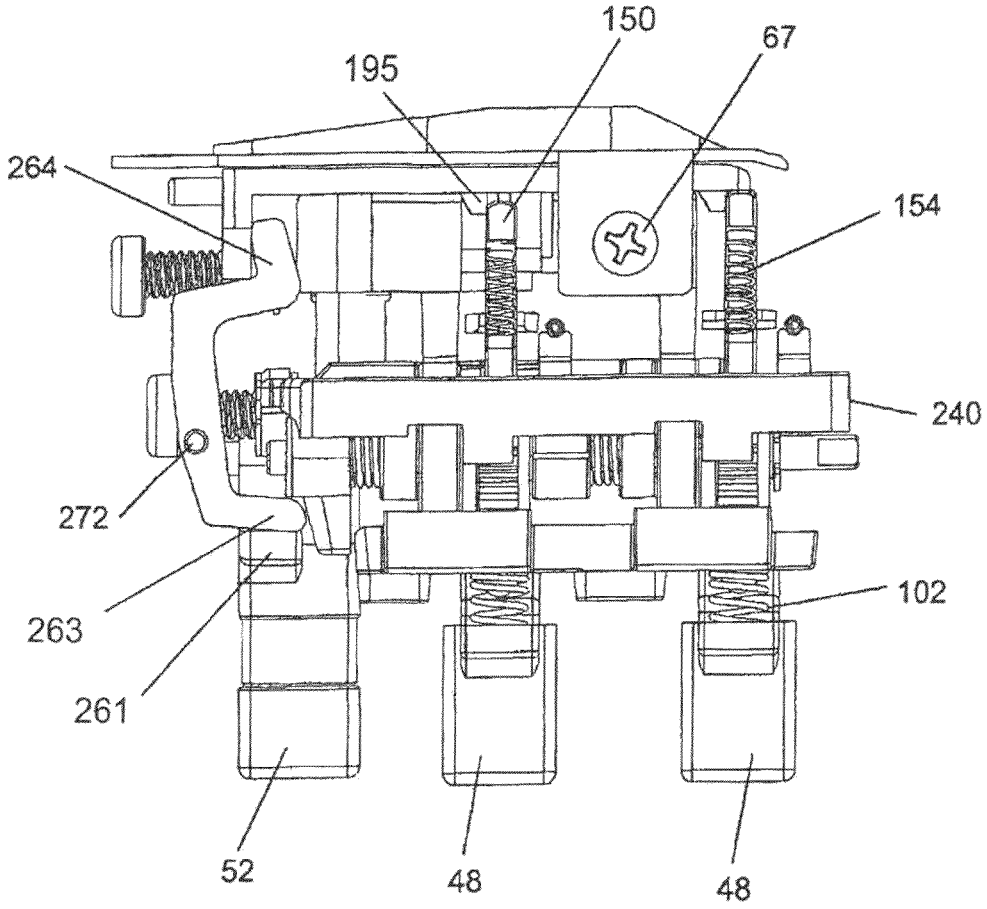
FIG. 23 is a side elevation of a gun lock assembly in a second reset mode of operation.
Figure 24:
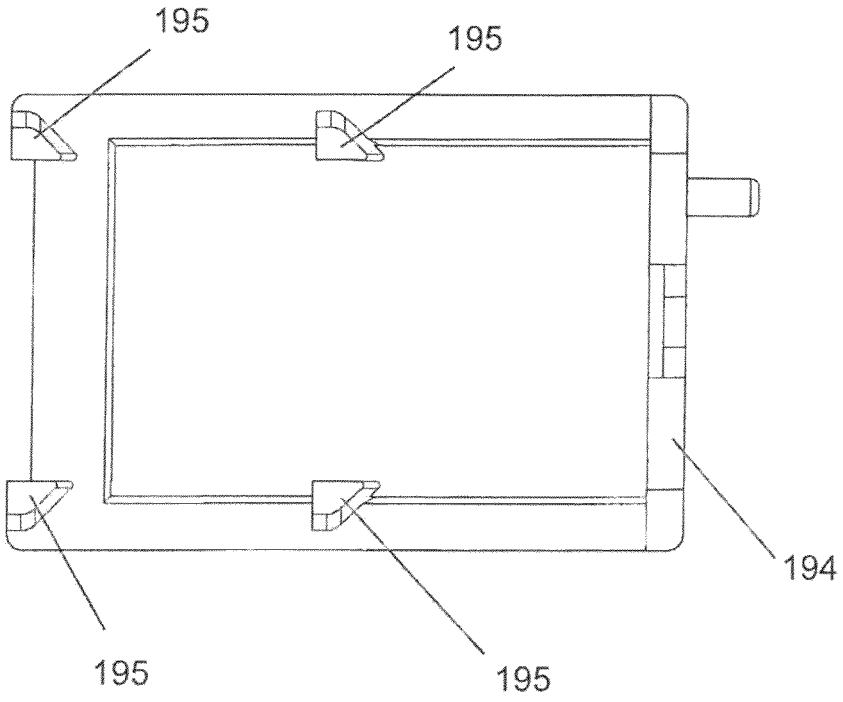
FIG. 24 is a bottom view of a pawl reset slide.

The operation of the reset button 52 is illustrated in FIGS. 22-23. The reset button 52 includes an abutment surface 261 which contacts proximal end 263 of lever arm 264. This will cause lever arm 264 to pivot about pivot pin 272 such that distal end 265 will engage pawl reset slide 194. Pawl reset slide 194 will be moved by contact with distal end 265 from the position shown in FIG. 22 to the position shown in this FIG. 23. The tabs 195 (FIG. 24) will engage the engagement surfaces 138 on retaining pawls 136 to cause retaining pawls 136 to pivot whereby retaining pawl heads 144 are moved out of engagement with teeth of the ratchet wheels 130 (FIG. 3).

Figure 25:
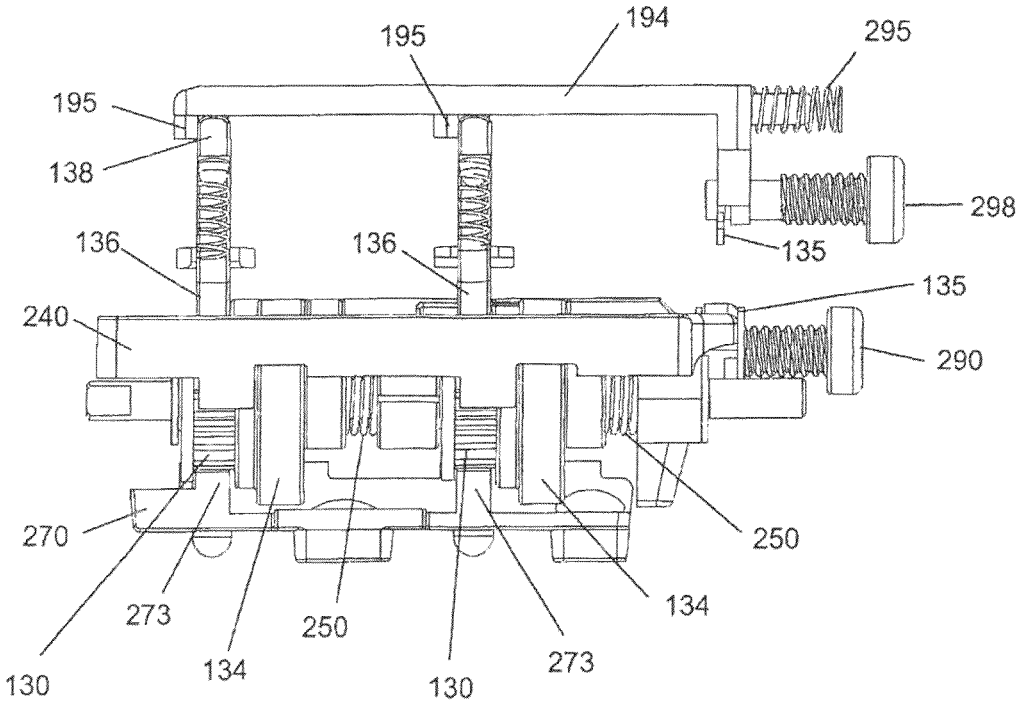
FIG. 25 is a side elevation of a gun lock assembly in a first combination change mode of operation.
Figure 26:
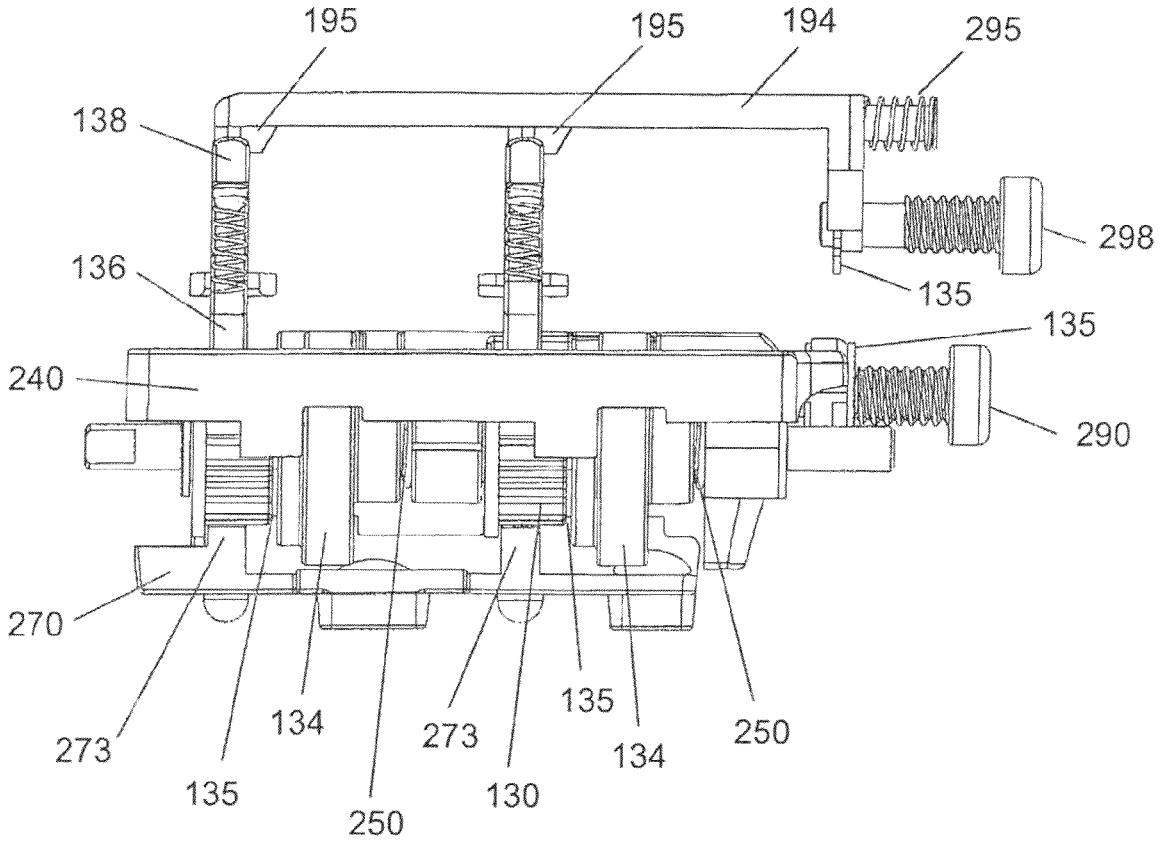
FIG. 26 is a side elevation of a gun lock assembly in a second combination change mode of operation FIG. 27 (*a-e*) is a perspective view of ratchet wheel and combination disk assemblies in sequential modes of operation.
Figure 27:
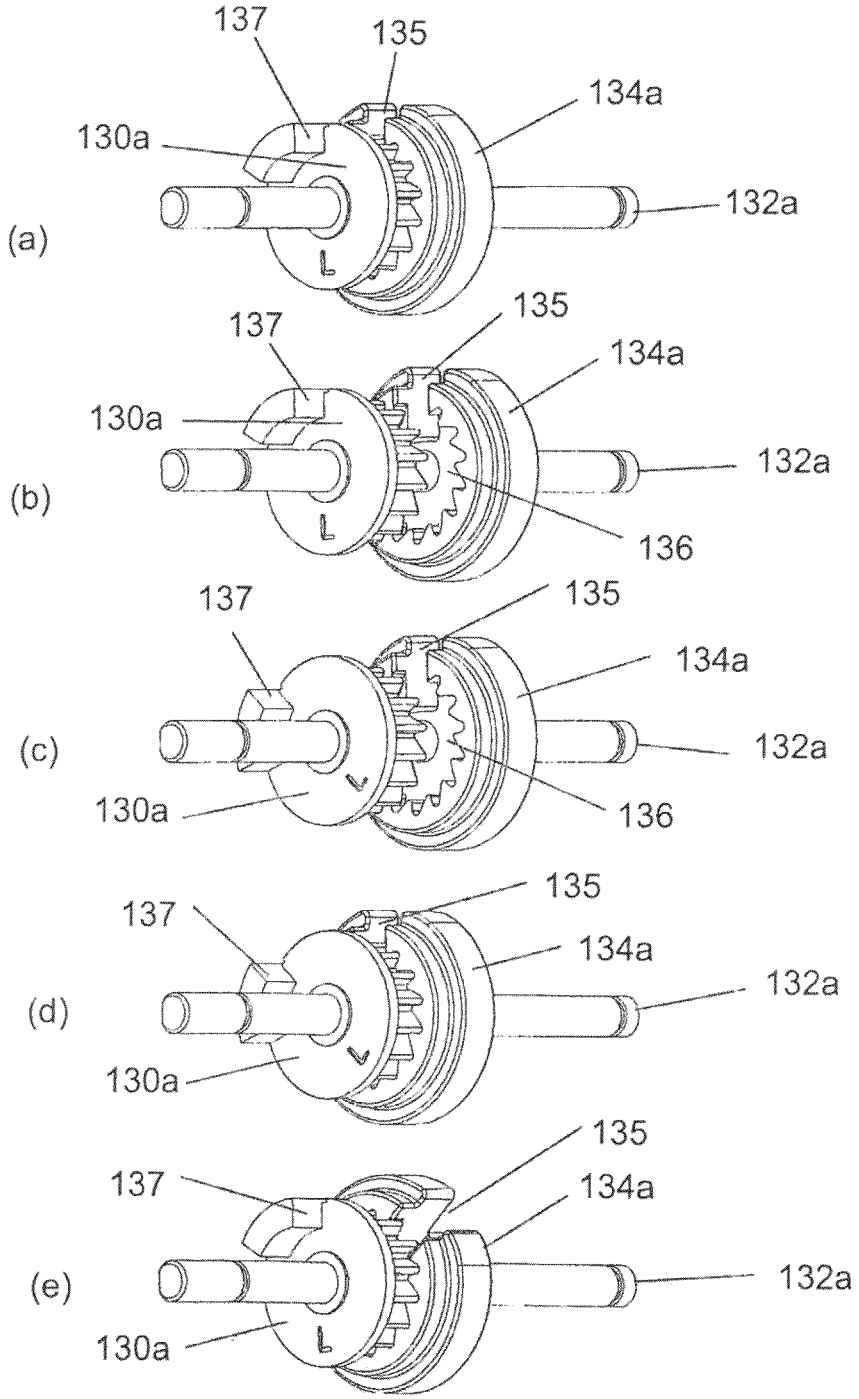
Figure 28:
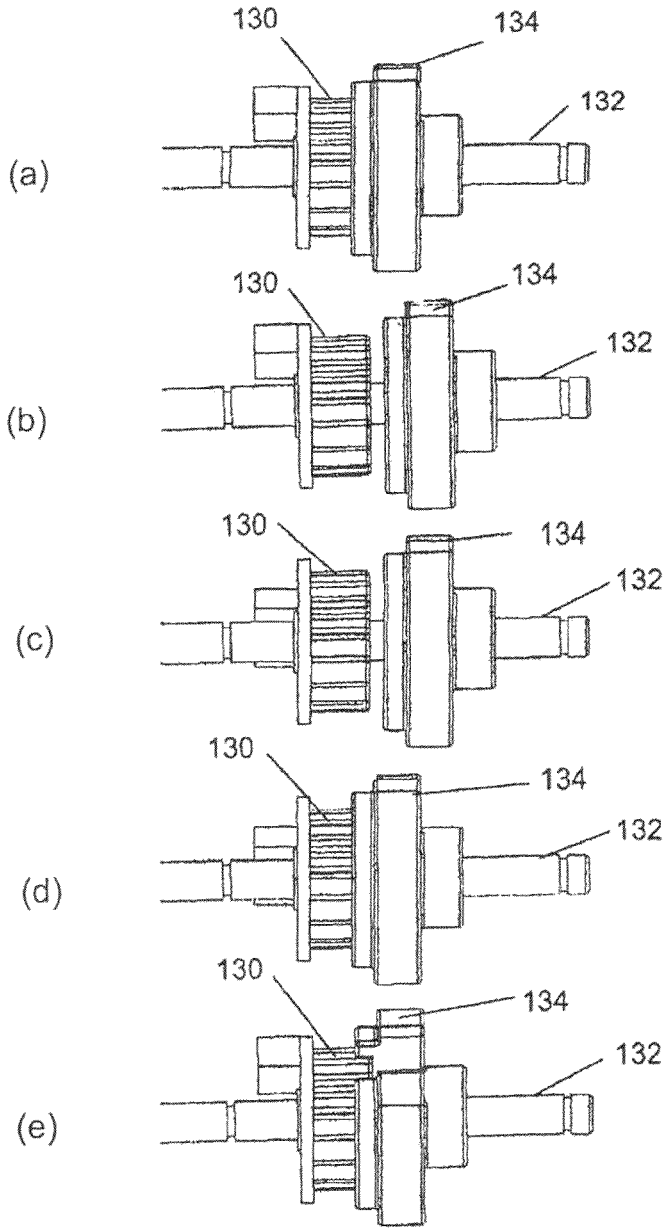
FIG. 28 (*a-e*) is a side elevation of ratchet wheel and combination disk assemblies in sequential modes of operation.
Figure 29:
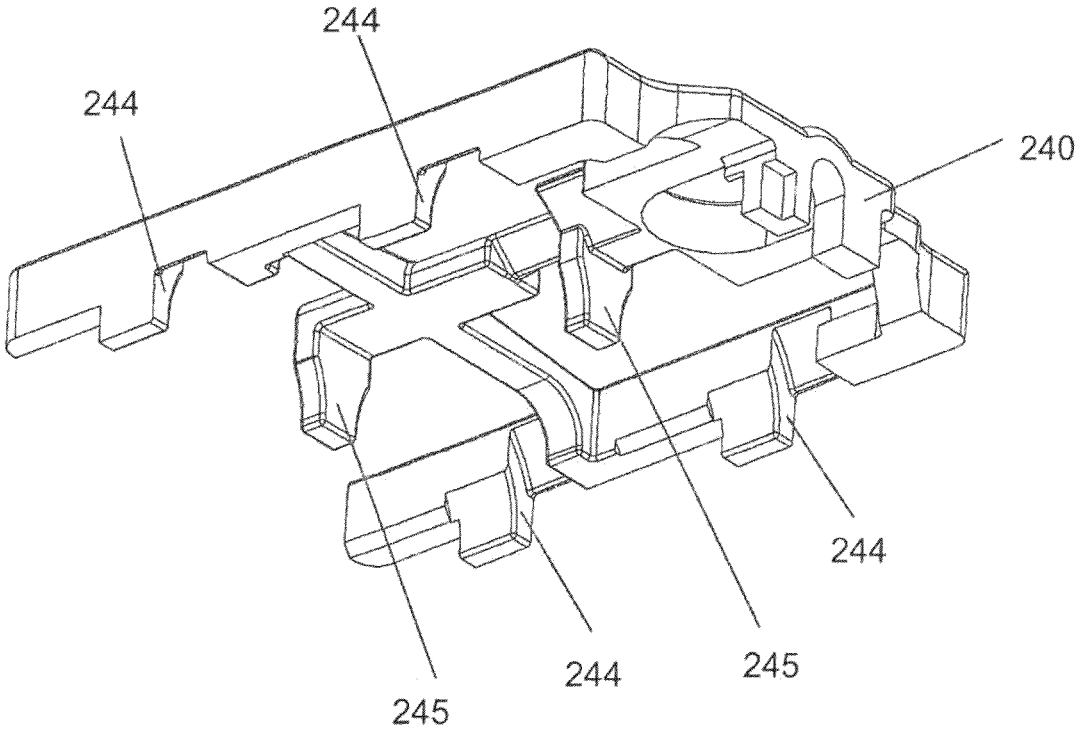
FIG. 29 is a perspective view of a disk reset slide.
Figure 30:
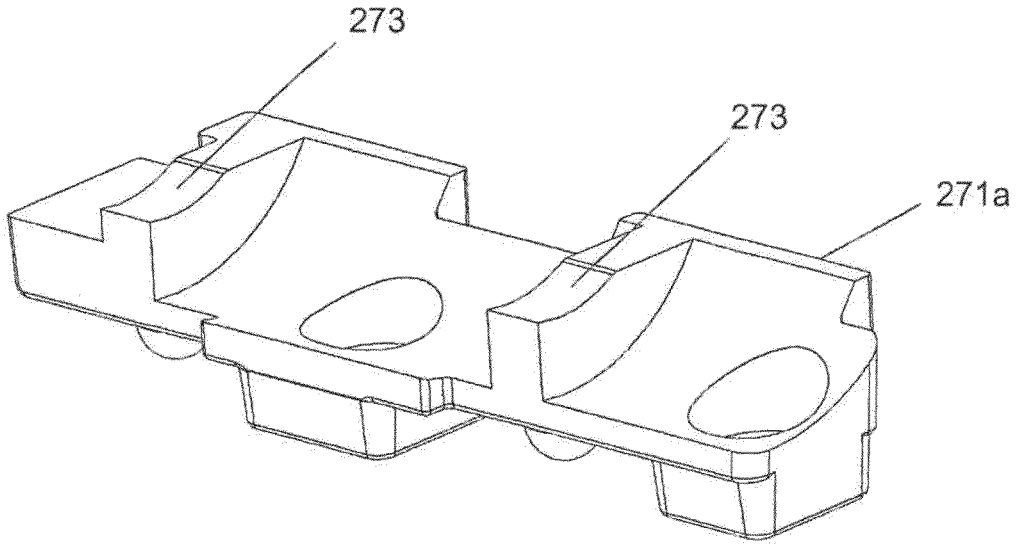
FIG. 30 is a perspective view of a ratchet wheel locator.

The operation of the combination changing features of the gun lock is illustrated in FIGS. 25-30. The initial position is shown in FIG. 25 where tabs 195 of retaining pawl reset slide 194 are out of contact with surfaces 138 of retaining pawls 136. The ratchet wheels 130 are engaged to the combination disks 134. The lock is unlocked such that the posts 94 are positioned in the slots 230 of the combination disks 134. The surfaces 273 of ratchet wheel locator 271 (FIG. 30) keep the ratchet wheels from moving when changing the combination. The screw 290 is unscrewed a suitable number of turns, for example three turns. This will move the combination disk reset slide 240 a suitable distance (for example 0.05") such that depending side tabs 244 and central tabs 245 (FIG. 29) are urged into contact with the combination disks 134. This will cause the combination disks 134 to move out of engagement with the ratchet wheels 130 (FIGS. 27-28*b*). The screw 298 is then rotated a suitable number of turns (for example 3 turns) which will cause the retaining pawl reset slide 194 to move a suitable distance (for example 0.05") such that the tabs 195 will contact engagement surfaces 138 of the retaining pawls 136 to move the retaining pawls 136 out of engagement with the ratchet wheels 130. The ratchet wheels 130 will thereby be rotated by the springs 250 to an initialized position where the stops 137 are all at "0". The screw 298 is then returned to the original position to re-engage the retaining pawls 136 with the ratchet wheels 130. The pushbuttons 48 can then be operated a suitable number of times to enter the new combination (FIGS. 27-28*c*). The screw 290 can then be rotated back to the original position to move the combination disks 134 into engagement with the ratchet wheels 130 with the ratchet wheel positioned relative to the respective combination disks and opening slots 230 at the new combination. Thereafter, this will be the combination necessary to rotate the ratchet wheels a suitable number of times to align the slots 230 with the posts 945 to permit unlocking the lock.

The gun lock of the invention can also be provided with structure that will engage a portion of the firearm such that when the lock is locked the magazine cannot be removed from the firearm. This will prevent unauthorized users from replacing a lock-equipped magazine with a magazine that does not have a lock. This can be any suitable structure such part of the locking arm 42 or some other mechanical interlocking structure that is engaged when the lock is locked.

Figure 31:
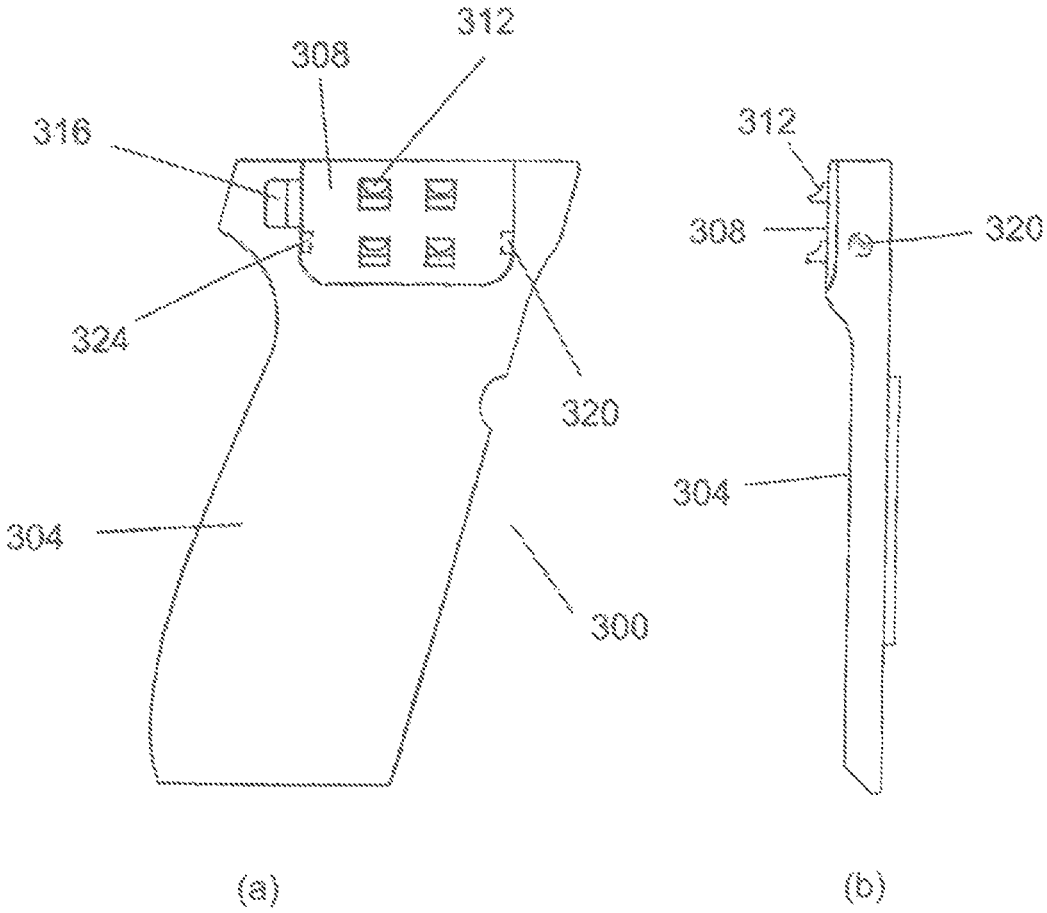
FIG. 31 is a (*a*) side elevation and a (*b*) front elevation of a gun lock according to the invention fixed to a hand grip.

The gun lock of the invention is capable of being integral with the firearm. The term integral means that the lock will be connected to and moved with the firearm even during operation of the firearm. The lock can be provided on the magazine as described above. The gun lock can also be provided as part of a hand grip assembly 300 as shown in FIG. 31. The hand grip 304 can have fixed thereto a lock 308 according to the invention. The lock 308 has push buttons 312 and a reset button 316. A combination disk rest slide screw 320 and retaining pawl reset slide screw 324 can also be provided. The lock can be placed elsewhere of the firearm.

A method for locking a gun having a firing mechanism includes the step of providing a gun lock fastened to a portion of the firearm and comprising engagement structure for engaging at least a portion of the firing mechanism and having a first position preventing operation of the firearm and having a second position permitting operation of the firearm, the gun lock being a combination lock, the combination lock comprising structure for permitting the changing of the combination required to unlock the lock and cause the engagement structure to move from the first position preventing operation of the firearm to the second position permitting operation of the firearm. The combination lock can be operated to lock and unlock the gun using a first combination for the combination lock. The combination required to lock and unlock the combination lock can then be changed.

The invention can be used as a stand-alone lock for other uses other than gun locks. The invention can take other embodiments without departing from the spirit or essential attributes thereof, and accordingly reference should be had to the following claims to determine the scope of the invention.

We claim:

1. A gun lock for locking firearms having a firing mechanism, comprising:

fastening structure for securing the lock to a portion of the firearm;

engagement structure for engaging at least a portion of the firing mechanism and having a first position preventing operation of the firearm and having a second position permitting operation of the firearm;

a plurality of rotatable ratchet wheels, each ratchet wheel having a biasing member associated therewith for urging the ratchet wheel to an initial position;

a combination disk engaged to and rotatable with an associated ratchet wheel, each combination disk being disengageable from the associated ratchet wheel;

a movable key carrier comprising a plurality of keys and each combination disk comprising an associated key-way, the keys being moveable into the key-ways upon the movement of the ratchet wheels and associated combination disk to an unlocking position wherein the key-ways are aligned with the associated keys, the engagement structure being attached to the key carrier, and thereby moving to the second position permitting operation of the firearm;

a push button combination-entering member associated with each ratchet wheel, and indexing pawls operably connected to the push buttons, operation of the push button combination-entering member causing the corresponding indexing pawl to engage the corresponding ratchet wheel to cause the ratchet wheel to rotate a predetermined angular distance with each operation of the associated push button combination-entering member;

retaining pawls associated with and engaged to the ratchet wheels for retaining the ratchet wheel against the bias of the biasing member;

a reset button, movement of the reset button moving the keys out of the key-ways and the retaining pawls out of contact with the ratchet wheels to permit rotation of the combination disks and the associated ratchet wheels;

a first combination-changing member operable to disengage the combination disks from the associated ratchet wheels to permit independent movement of the combination disks and the associated ratchet wheels, and thereby relative movement of the key-way of the combination disk relative to the initial position of the associated ratchet wheel, and also operable to reengage the combination disks with the associated ratchet wheels; and, a second combination-changing member operable to move the retaining pawls out of and into contact with the ratchet wheels while the keys remain in the associated key-ways, whereby the ratchet wheels can be returned to the initial position and the combination disks will be maintained in the initial position so as to permit the entering of a new combination by pushing each push button a number of times corresponding to the new combination, and upon reengagement of the combination disks with the associated ratchet wheels thereby changing the combination of operations of the push button combination-entering members required to align the key-ways of the associated combination disks and ratchet wheels with the keys of the movable key carrier to unlock the lock and operate the firearm.

2. The gun lock of claim 1, further comprising a retaining pawl reset slide for contacting the retaining pawls and moving the retaining pawls out of engagement with the associated ratchet wheels.

3. The gun lock of claim 2, wherein movement of the reset button moves the retaining pawl reset slide, the retaining pawl reset slide having tabs for engaging the retaining pawls to move the retaining pawls out of engagement with the ratchet wheels.

4. The gun lock of claim 3, further comprising a reset lever, movement of the reset button moving the reset lever and causing the reset lever to contact the retaining pawl reset slide, whereby the retaining pawl reset slide will be moved and the tabs will be caused to engage the retaining pawls.

5. The gun lock of claim 3, wherein the firing mechanism engagement structure is operatively connected at one end thereof to the key carrier.

6. The gun lock of claim 1, wherein the ratchet wheels comprise an initializing stop.

7. The gun lock of claim 1, further comprising biasing structure for urging the combination disks and ratchet wheels into engagement.

8. The gun lock of claim 7, wherein the first combination-changing member comprises a combination disk reset slide for urging the combination disks out of engagement with the ratchet wheels.

9. The gun lock of claim 8, wherein the first combination-changing member further comprises an adjusting screw engaged to the combination disk reset slide, rotation of the adjusting screw moving the combination disk reset slide to urge the combination disks out of engagement with the ratchet wheels.

10. The gun lock of claim 1, wherein the ratchet wheels and combination disks have cooperating engagement teeth and grooves for detachably engaging the ratchet wheels to the combination disks.

11. The gun lock of claim 1, wherein the ratchet wheels and combination disks are rotatably mounted on shafts.

12. The gun lock of claim 1, wherein two shafts are provided, each shaft having two cooperating combination disk and ratchet wheel pairs.

13. The gun lock of claim 1, wherein the gun lock is provided on a magazine clip.

14. The gun lock of claim 1, wherein the gun lock is provided on a hand grip.

15. A method for locking a gun having a firing mechanism, comprising the steps of:

providing a lock fastened to a portion of the firearm and comprising engagement structure for engaging at least a portion of the firing mechanism and having a first position preventing operation of the firearm and having a second position permitting operation of the firearm, the gun lock being a combination lock, the combination lock comprising:

a plurality of rotatable ratchet wheels, each ratchet wheel having a biasing member associated therewith for urging the ratchet wheel to an initial position;

a combination disk engaged to and rotatable with an associated ratchet wheel, each combination disk being disengageable from the associated ratchet wheel;

a movable key carrier comprising a plurality of keys and each combination disk comprising an associated key-way, the keys being moveable into the key-ways upon the movement of the ratchet wheels and associated combination disk to an unlocking position wherein the key-ways are aligned with the associated keys, the engagement structure being attached to the key carrier, and thereby moving to the second position permitting operation of the firearm;

a push button combination-entering member associated with each ratchet wheel, and indexing pawls operably connected to the push buttons, operation of the push button combination-entering member causing the corresponding indexing pawl to engage the corresponding ratchet wheel to cause the ratchet wheel to rotate a predetermined angular distance with each operation of the associated push button combination-entering member;

retaining pawls associated with and engaged to the ratchet wheels for retaining the ratchet wheel against the bias of the biasing member;

a reset button, movement of the reset button moving the keys out of the key-ways and the retaining pawls out of contact with the ratchet wheels to permit rotation of the combination disks and the associated ratchet wheels;

a first combination-changing member operable to disengage the combination disks from the associated ratchet wheels to permit independent movement of the combination disks and the associated ratchet wheels, and thereby relative movement of the key-way of the combination disk relative to the initial position of the associated ratchet wheel, and also operable to reengage the combination disks with the associated ratchet wheels; and, a second combination-changing member operable to move the retaining pawls out of and into contact with the ratchet wheels while the keys remain in the associated key-ways, whereby the ratchet wheels can be returned to the initial position and the combination disks will be maintained in the initial position so as to permit the entering of a new combination by pushing each push button a number of times corresponding to the new combination, and upon reengagement of the combination disks with the associated ratchet wheels thereby changing the combination of operations of the push button combination-entering members required to align the key-ways of the associated combination disks and ratchet wheels with the keys of the movable key carrier to unlock the lock and operate the firearm;

operating the combination lock to lock and unlock the gun using a first combination for the combination lock; and, changing the combination required to lock and unlock the combination lock.

16. A gun lock for a firearm comprising a firing mechanism, the qun lock comprising engagement structure for engaging at least a portion of the firing mechanism and having a first position preventing operation of the firearm and having a second position permitting operation of the firearm, the gun lock being a combination lock having a combination to unlock the combination lock, the combination lock comprising key structure connected to a key carrier for moving into corresponding key-way structure upon entry of the combination, the engagement structure, the key carrier and key structure being operatively attached to one of at least two pivoting levers, a first pivoting lever being attachable to the key carrier at a first set of connection locations on the key carrier wherein the engagement structure moves a first direction relative to the key carrier and the key structure upon opening of the lock, the key carrier comprising a second set of connection locations, and a second pivoting lever that can be attached to the key carrier at the second set of connection locations such that the engagement structure moves in an opposite, reversing direction relative to the key carrier and the key structure upon opening of the lock.

* * * * *